US012137740B2

(12) United States Patent
Zhang et al.

(10) Patent No.: US 12,137,740 B2
(45) Date of Patent: Nov. 12, 2024

(54) POROUS HEATING BODY AND ATOMIZER HAVING SAME

(71) Applicant: SHENZHEN FIRST UNION TECHNOLOGY CO., LTD., Shenzhen (CN)

(72) Inventors: Qing Zhang, Shenzhen (CN); Jun Yuan, Shenzhen (CN); Yunkai Zhang, Shenzhen (CN); Zhengfa Li, Shenzhen (CN); Desheng Huang, Shenzhen (CN); Baoling Lei, Shenzhen (CN); Yonghai Li, Shenzhen (CN); Zhongli Xu, Shenzhen (CN)

(73) Assignee: SHENZHEN FIRST UNION TECHNOLOGY CO., LTD., Shenzhen (CN)

( * ) Notice: Subject to any disclaimer, the term of this patent is extended or adjusted under 35 U.S.C. 154(b) by 648 days.

(21) Appl. No.: 17/294,511

(22) PCT Filed: Nov. 6, 2019

(86) PCT No.: PCT/CN2019/116008
§ 371 (c)(1),
(2) Date: May 17, 2021

(87) PCT Pub. No.: WO2020/098544
PCT Pub. Date: May 22, 2020

(65) Prior Publication Data

US 2022/0007724 A1 Jan. 13, 2022

(30) Foreign Application Priority Data

Nov. 15, 2018 (CN) ..... 201811357024

(51) Int. Cl.
*A24F 40/46* (2020.01)
*A24F 40/10* (2020.01)
(Continued)

(52) U.S. Cl.
CPC ..... *A24F 40/46* (2020.01); *A24F 40/10* (2020.01); *A24F 40/42* (2020.01); *A24F 40/485* (2020.01)

(58) Field of Classification Search
None
See application file for complete search history.

(56) References Cited

U.S. PATENT DOCUMENTS 10,070,668 B2 * 9/2018 Li ..... A24F 40/40
11,583,005 B2 * 2/2023 Deng ..... A24F 40/485
(Continued)

FOREIGN PATENT DOCUMENTS

CN 104068476 A 10/2014
CN 105394814 A 3/2016
(Continued)

*Primary Examiner* — Oscar C Jimenez
(74) *Attorney, Agent, or Firm* — Cheng-Ju Chiang

(57) ABSTRACT

A porous heating body includes a porous body having a first porous portion, a second porous portion and a third porous portion successively disposed in the porous body along a lengthwise direction of the porous body. A cross-sectional area of the first porous portion and a cross-sectional area of the third porous portion are both larger than a cross-sectional area of the second porous portion along a widthwise direction of the porous body. A heating element extends along the lengthwise direction of the porous body is disposed on the porous body. The heating element includes a heating portion. At least one portion of an extension length of the heating portion is overlapped with an extension length of the second porous portion. The porous body is shaped to enhance conductivity of liquid tobacco in a middle thereof, and storing liquid tobacco for replenishing at two bulge ends thereof.

18 Claims, 13 Drawing Sheets

(51) Int. Cl.
*A24F 40/42* (2020.01)
*A24F 40/485* (2020.01)

(56) References Cited

U.S. PATENT DOCUMENTS

| | | | | |
|---|---|---|---|---|
| 11,653,701 | B2 * | 5/2023 | Simpson | A24F 40/46 131/329 |
| 11,812,791 | B2 * | 11/2023 | Wensley | A24F 40/46 |
| 2017/0105453 | A1 * | 4/2017 | Li | C04B 38/00 |
| 2020/0187568 | A1 * | 6/2020 | Li | A24F 40/485 |
| 2021/0212372 | A1 * | 7/2021 | Liu | A24F 40/485 |
| 2023/0148664 | A1 * | 5/2023 | Hijma | A24F 40/42 131/329 |

FOREIGN PATENT DOCUMENTS

| | | | |
|---|---|---|---|
| CN | 105433442 | A | 3/2016 |
| CN | 205321217 | U | 6/2016 |
| CN | 205695698 | U | 11/2016 |
| CN | 106263044 | A | 1/2017 |
| CN | 206005952 | U | 3/2017 |
| CN | 108308715 | A | 7/2018 |
| CN | 109349680 | A | 2/2019 |
| CN | 109349681 | A | 2/2019 |
| CN | 209376686 | U | 9/2019 |
| EP | 3292773 | A1 | 3/2018 |

* cited by examiner

POROUS HEATING BODY AND ATOMIZER HAVING SAME

CROSS REFERENCE TO RELATED APPLICATIONS

The present application is a 35 U.S.C. § 371 National Phase conversion of International PCT) Patent Application No. PCT/CN2019/116008, filed on Nov. 6, 2019, which claims priority of Chinese Patent Application No. 201811357024.7, filed on Nov. 15, 2018, entitled as "Porous Heating body, Atomizer Having Porous Heating Body and Manufacturing Method for Porous Heating Body" in China National Intellectual Property Administration, the entire disclosure of which is incorporated by reference herein. The PCT International Patent Application was filed and published in Chinese.

BACKGROUND OF THE INVENTION

1. Field of the Invention

The present invention relates to a technical field of electronic cigarettes, particularly relates to a porous heating body and an atomizer having the porous heating body.

2. The Related Arts

A core part for electronic cigarettes is an atomizer for atomizing liquid tobacco of electronic cigarettes. Function of the atomizer is achieved due to the atomizing being constituted by a porous part and a heating part. The porous part is a part having capillary mini-pores disposed inside the porous part itself, and can permeantly absorb and conduct liquid tobacco through its inside mini-pores. The heating part has a heating portion for heating and an electrically conductive pin portion. The heating portion is used to heat and vaporize the liquid tobacco conducted by the porous part to form aerosol from the liquid tobacco for inhaling of users.

Currently, the porous part is usually made by porous fiber, porous ceramic and foamed metal, etc. The porous part having a rigid structure is usually designed for use as being shaped as a hollow pillar and/or a prism. The heating part is embedded in the porous part, and a whole assembly of the heating part and the porous part is installed in an atomizer outer housing with a fixed size.

The porous part with the above mentioned shape and structure has following shortcomings. On the one hand, speed of wetting and conduction of liquid tobacco in the hollow pillar shaped structure is relatively low since an inner diameter and an outer diameter of the porous part are respectively constant. As a result, conducted liquid tobacco is easily not enough and such fact will cause decomposition of essences and fragrances to further lead to an insufficient degree of revivification regarding experience of mouthfeel or lead to burning smell due to dry burning of heating wires. On the other hand, any structure or part of the outer housing cannot be conveniently made due to the pillar shape of the porous part with the constant outer diameter. As a result, a steady installation and sealing of a final product cannot be conveniently achieved.

SUMMARY OF THE INVENTION

In order to solve the aforementioned problem of products using conventional technology regarding conduction problem of liquid tobacco for the porous part and installation problem of the porous part, a porous heating body with a better conductivity of liquid tobacco, and convenient installation and sealing in accordance with the present invention is provided.

The porous heating body in accordance with an embodiment of the present invention has a porous body used for conducting liquid tobacco. The porous body includes a first porous portion, a second porous portion and a third porous portion successively disposed in the porous body along a lengthwise direction of the porous body. A cross-sectional area of the first porous portion and a cross-sectional area of the third porous portion are both larger than a cross-sectional area of the second porous portion along a widthwise direction of the porous body.

A heating element extends along the lengthwise direction of the porous body is disposed on the porous body. The heating element includes a heating portion used for atomizing the liquid tobacco to generate aerosol. At least one portion of an extension length of the heating portion along the lengthwise direction of the porous body is overlapped with an extension length of the second porous portion.

Preferably, the cross-sectional area of the first porous portion along the widthwise direction of the porous body is constant, and/or the cross-sectional area of the second porous portion along the widthwise direction of the porous body is constant, and/or the cross-sectional area of the third porous portion along the widthwise direction of the porous body is constant.

Preferably, the cross-sectional area of the first porous portion along the widthwise direction of the porous body is gradually decreased along a forwarding direction of the lengthwise direction of the porous body toward the second porous portion.

Preferably, the first porous portion includes a first conductive section and a second conductive section being successively disposed along a forwarding direction of the lengthwise direction of the porous body toward the second porous portion.

A cross-sectional area of the first conductive section along the widthwise direction of the porous body is constant.

A cross-sectional area of the second conductive section along the widthwise direction of the porous body is gradually decreased along the forwarding direction of the lengthwise direction of the porous body toward the second porous portion.

Preferably, the cross-sectional area of the third porous portion along the widthwise direction of the porous body is gradually decreased along a forwarding direction of the lengthwise direction of the porous body toward the second porous portion.

Preferably, the third porous portion includes a third conductive section and a fourth conductive section being successively disposed along a forwarding direction of the lengthwise direction of the porous body toward the second porous portion.

A cross-sectional area of the third conductive section along the widthwise direction of the porous body is constant.

A cross-sectional area of the fourth conductive section along the widthwise direction of the porous body is gradually decreased along the forwarding direction of the lengthwise direction of the porous body toward the second porous portion.

On the basis of the above porous heating body, a product of an atomizer including the above porous heating body is further provided in accordance with the present invention. The atomizer includes a hollowing outer shell, and the outer shell includes a liquid tobacco storage cavity disposed inside the outer shell for storing liquid tobacco. A porous heating body is further disposed inside the outer shell to absorb liquid tobacco from the liquid tobacco storage cavity and to atomize the absorbed liquid tobacco. The porous heating body disposed in the outer shell is the above porous heating body.

Preferably, the porous body further includes at least one through hole disposed therein and successively penetrating the first porous portion, the second porous portion and the third porous portion along the lengthwise direction of the porous body.

Preferably, the porous body further includes at least one through hole disposed therein and successively penetrating the first porous portion, the second porous portion and the third porous portion along the lengthwise direction of the porous body.

Preferably, an inner wall of one of the at least one through hole comprises a first liquid tobacco working face, the second porous portion includes a second liquid tobacco working face corresponding to the first liquid tobacco working face along a radial direction of the one through hole.

When the porous body is set to include more than two through holes and the one through hole is set to be a preset through hole out of the more than two through holes, a distant between the first liquid tobacco working face and the second liquid tobacco working face is constant along a radial direction of the preset through hole.

Preferably, the one through hole is used for conducting aerosol out. The first liquid tobacco working face is set to be an atomizing face for atomizing liquid tobacco. The heating portion of the heating element is disposed on the atomizing face. The second liquid tobacco working face is set to be a liquid tobacco contacting face to contact liquid tobacco in the liquid tobacco storage cavity.

Preferably, the inner wall of the one through hole comprises two opposite atomizing faces, a first heating portion and a second heating portion are respectively disposed correspondingly on the two atomizing faces, the first heating portion and the second heating portion are electrically connected in parallel or in series.

Preferably, the one through hole is communicated with the liquid tobacco storage cavity, the first liquid tobacco working face is set to be a liquid tobacco contacting face to contact liquid tobacco in the liquid tobacco storage cavity, and the second liquid tobacco working face is set to be an atomizing face for atomizing liquid tobacco, the heating portion is disposed on the atomizing face.

Preferably, a shortest conductive distance of liquid tobacco conducted through the liquid tobacco contacting face to a corresponding atomizing face is smaller than a distance between the inner wall of the one through hole and an outer surface of the first porous portion or the third porous portion along the radial direction of the one through hole.

Preferably, the at least one through hole includes a first through hole and a second through hole successively penetrating the first porous portion, the second porous portion and the third porous portion along the lengthwise direction of the porous body.

The heating element includes a first heating portion disposed on an atomizing face of the first through hole, and a second heating portion disposed on an atomizing face of the second through hole, the first heating portion and the second heating portion are set to have different heating temperatures from each other.

Preferably, an aerosol conductive tube is disposed inside the outer shell to conduct aerosol atomized by the porous heating body from liquid tobacco out of the atomizer. A fixing seat is disposed inside the outer shell to fix the porous heating body. A connecting piece is disposed inside the outer shell to connect the porous heating body with the aerosol conductive tube.

The fixing seat includes a first accommodating portion to mate with the first porous portion.

The connecting piece includes a second accommodating portion to mate with the third porous portion and a connecting portion to connect with the aerosol conductive tube.

The porous heating body is connected with the fixing seat through the first porous portion mating with the first accommodating portion, and is connected with the connecting piece through the third porous portion mating with the second accommodating portion.

The above porous heating body in accordance with the present invention is adopted to have advantages as follows. A middle of the porous body has a relatively shorter conductive distance for liquid tobacco to facilitate enhancing conductivity of liquid tobacco through the porous body being shaped as a dumbbell having a slim middle and two bulge ends when liquid tobacco is atomized. The two bulge ends of the porous body, on the one hand, can have an effect to store liquid tobacco therein and to replenish liquid tobacco in the middle of the porous body due to liquid tobacco consumption thereof. As a result, liquid tobacco replenishing efficiency is enhanced when liquid tobacco in the middle of the porous body is atomized. On the other hand, the shape of the porous body facilitates fixation and sealing connection of the porous body with other parts being conveniently achieved. Meanwhile, generated heat in the middle of the porous body can be reduced to be conducted toward parts disposed at two ends of the porous heating body for connection with the porous heating body.

Based on the idea to allow the porous body having a higher conductivity of liquid tobacco, a manufacturing method to made the porous body having a high quantity of aerosol generation and high efficiency of aerosol generation in accordance with the present invention is further provided. A product of the porous body acquired via the above method is also provided. The method includes the following.

Raw material consisting of the following ingredients based on respective mass percentages is acquired. The ingredients include 50%~75% of diatomite, 0%~10% of aluminum oxide, 15%~35% of pore formers, 5%~10% of clay and 5%~15% of glass powders.

The above ingredients are uniformly blended with paraffin to form a paraffin lump of raw material.

The paraffin lump of raw material is pressed in pressure based on a required shape of final products to form a rough blank.

The rough blank is firstly kept warmth under a temperature of 200° C.~500° C. for 4~10 hours, and then is sintered under a temperature of 700° C.~1,200° C. for 2~4 hours to acquire the porous body.

The pore former is selected from at least one kind of sucrose, amylum, wood fiber and short carbon fiber.

Preferably, before the step that the ingredients are uniformly blended with paraffin to form a paraffin lump of raw material, the method further includes the following.

The ingredients are treated under wet ball grinding via using mediums including deionized water or absolute ethanol.

Preferably, in the step that the paraffin lump of raw material is pressed in pressure based on a required shape of final products, the following is adopted.

The step of pressing in pressure is proceeded under a condition of a temperature of 70° C.~85° C. and a pressure of 0.4 MPa~1 MPa.

BRIEF DESCRIPTION OF THE DRAWINGS

One or more embodiments in accordance with the present invention are illustratively exemplified for explanation through figures shown in the corresponding attached drawings. These exemplified descriptions do not constitute any limitation on the embodiments. The elements with the same reference numerals in the attached drawings are denoted as similar elements. Unless otherwise stated, the figures in the attached drawings do not constitute any scale limitation.

DETAILED DESCRIPTION OF PREFERRED EMBODIMENT

In order to facilitate understanding of the present invention, the present invention is described in more details below with reference to the accompanying drawings and specific embodiments.

The porous heating body in accordance with an embodiment of the present invention is mainly adapted for an atomizer of electronic cigarette products. Of course, based on the same functions of liquid tobacco conduction and atomization, the present invention can also be extended to be applied in volatilization devices for liquid medicine ingredients or other release devices for aromatic ingredients. In the following embodiments of the present invention, an electronic cigarette is exemplified for description and illustration.

Figure 1:
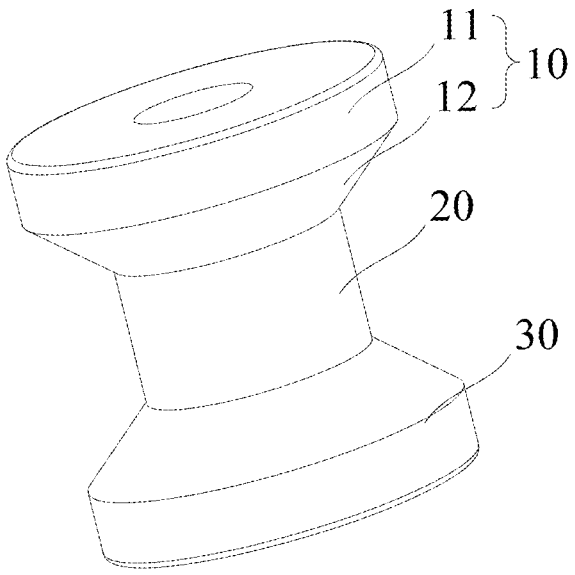
FIG. 1 shows a schematic perspective structural view of a porous heating body in accordance with a preferred embodiment of the present invention.

An outline perspective structural view of a porous heating body in accordance with a preferred embodiment of the present invention can be referred to FIG. 1. A whole shape of the porous heating body is substantially shaped as a dumbbell. All kinds of similar variety can be proceeded based on the shape of the heating body shown in FIG. 1. An integrated structural principle of shape design for the porous heating body can be illustrated via referring to FIG. 2. The porous heating body in accordance with the preferred embodiment of the present invention includes a cylindrical porous body extending lengthwise, and a heating element in contact with the porous body. An interior of the porous body is a structure with micropores which are used to permeantly conduct liquid tobacco to the heating element. The heating element is used to heat the liquid tobacco for generating aerosol. A first porous portion 10, a second porous portion 20 and a third porous portion 30 are successively coaxially disposed in the porous body along a lengthwise direction of the porous body.

Along a widthwise direction of the porous body, an outer diameter of the first porous portion 10 and an outer diameter of the third porous portion 30 are both larger than an outer diameter of the second porous portion 20.

Figure 2:
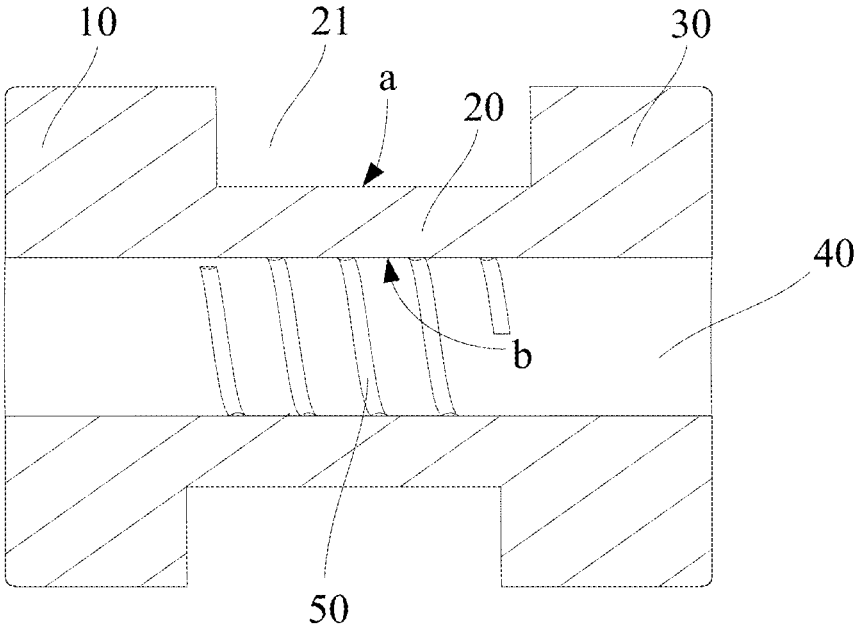
FIG. 2 shows a schematic cross-sectional view of a porous heating body along a lengthwise direction thereof in accordance with another preferred embodiment of the present invention.
Figure 7:
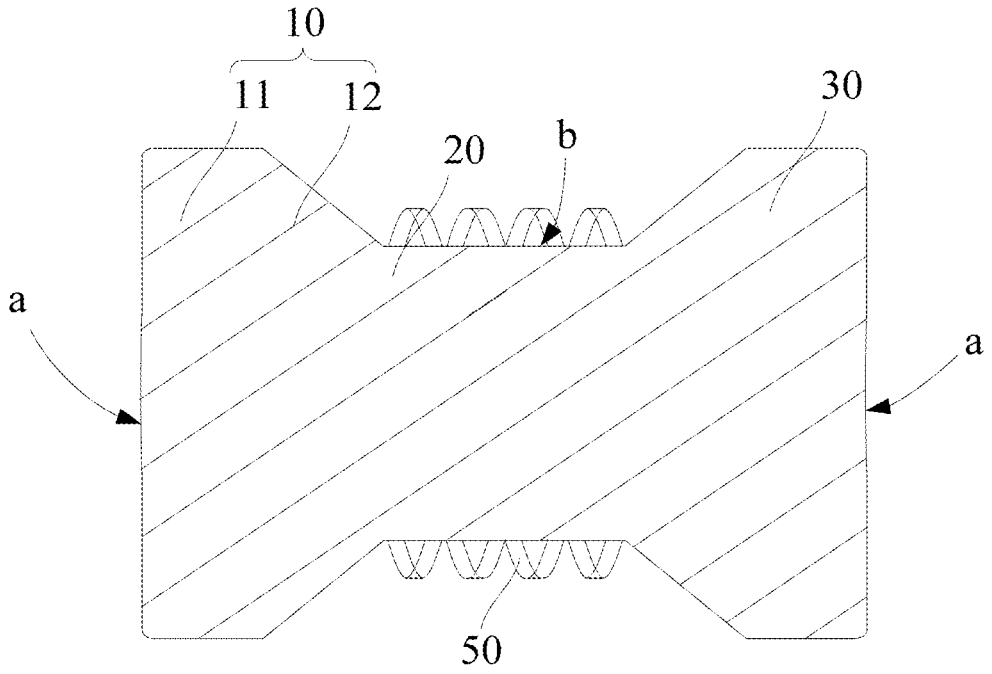
FIG. 7 shows a schematic cross-sectional view of a porous heating body along a lengthwise direction thereof in accordance with further another preferred embodiment of the present invention.
Figure 8:
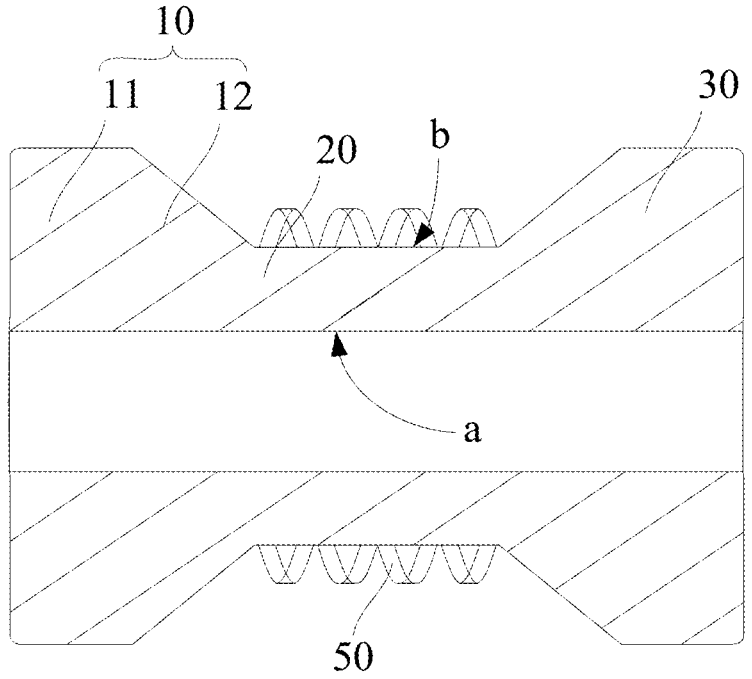
FIG. 8 shows a schematic cross-sectional view of a porous heating body along a lengthwise direction thereof in accordance with further another preferred embodiment of the present invention.
Figure 9:
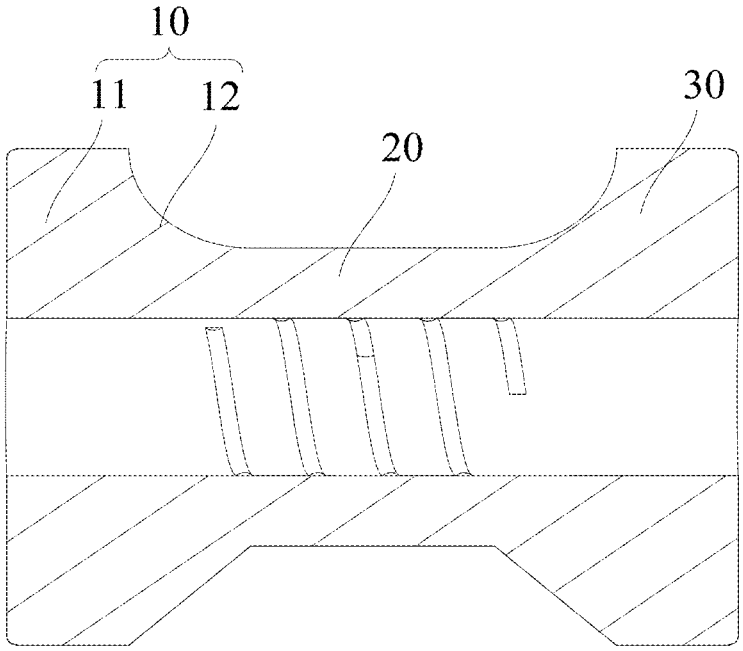
FIG. 9 shows a schematic cross-sectional view of a porous heating body along a lengthwise direction thereof in accordance with further another preferred embodiment of the present invention.
Figure 10:
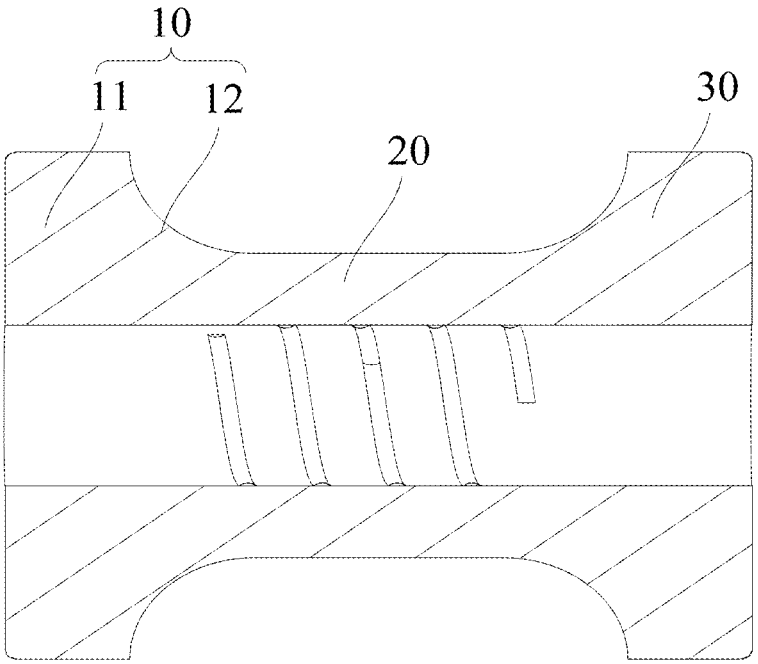
FIG. 10 shows a schematic cross-sectional view of a porous heating body along a lengthwise direction thereof in accordance with the preferred embodiment of the present invention.
Figure 11:
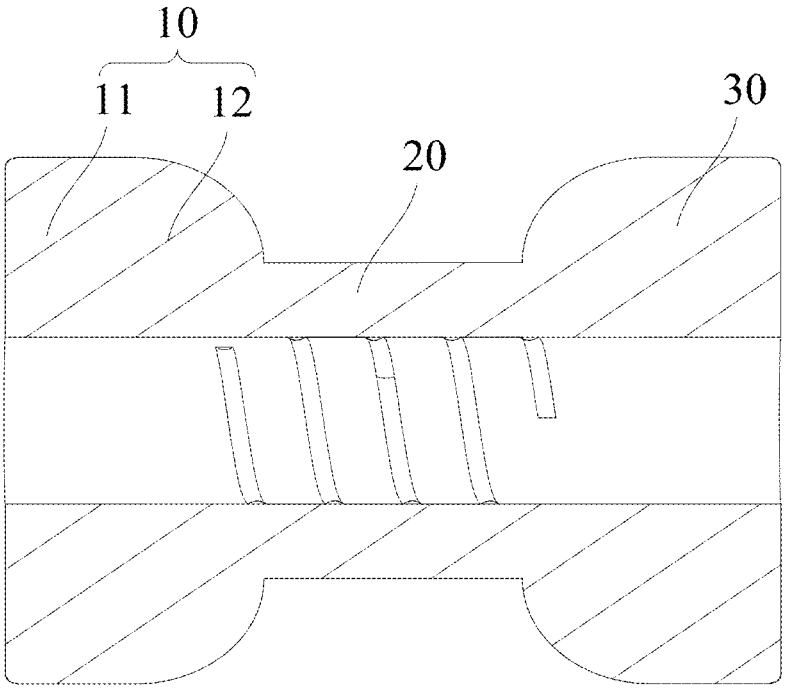
FIG. 11 shows a schematic cross-sectional view of a porous heating body along a lengthwise direction thereof in accordance with further another preferred embodiment of the present invention.
Figure 15:
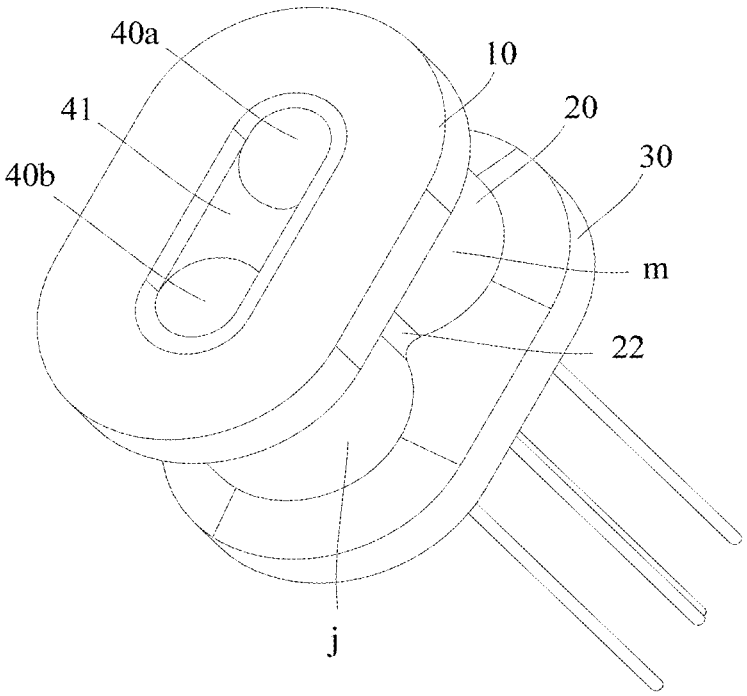
FIG. 15 shows a schematic perspective structural view of a porous heating body in accordance with another preferred embodiment of the present invention.
Figure 16:
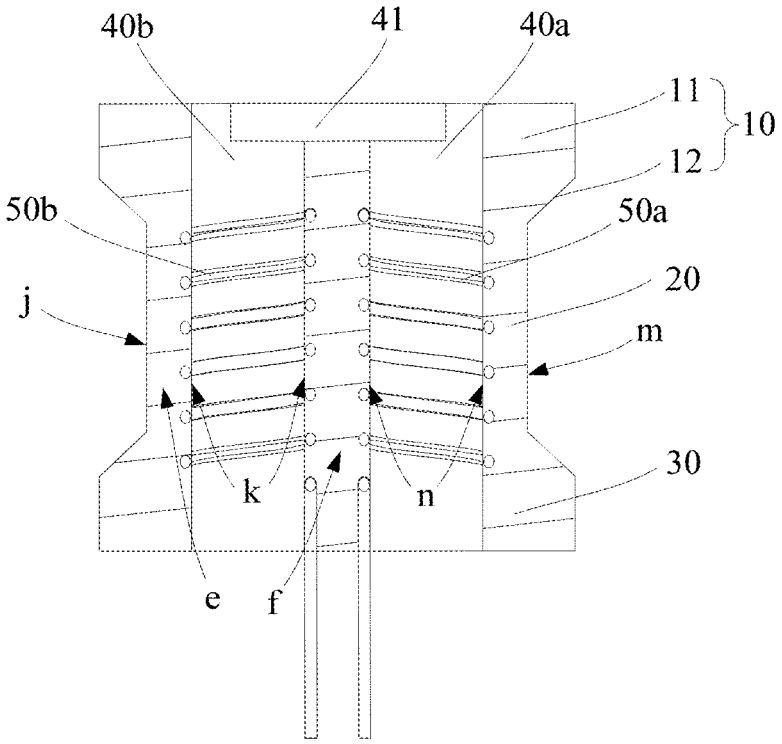
FIG. 16 shows a schematic cross-sectional view of the porous heating body of FIG. 15 along a lengthwise direction thereof in accordance with the another preferred embodiment of the present invention.

The porous body having the above mentioned structure is divided into three portions along its lengthwise direction, successively including the first porous portion 10, the second porous portion 20 and the third porous portion 30. Meanwhile, the outer diameter of the second porous portion 20 are smaller than the outer diameter of the first porous portion 10 and the outer diameter of the third porous portion 30 along the widthwise direction of the porous body. A concave cavity 21 is formed on an outer surface of the porous body corresponding to the second porous portion 20. As a result, the whole porous body is shaped as a dumbbell. The heating element can be formed on the porous body via a manufacturing process such as sintering, printing, coating and etching, etc. In the meantime, the heating element can be alternatively disposed on the porous body as an independent part in advance. The heating element has a structure having two parts. The two parts are respectively an independent heating portion 50 and electrode pins electrically connecting the heating portion 50 with electrodes of a power supply to power the heating portion 50 (or called as electrically conducting connection portions, no such electrode pins being shown in the heating elements of embodiments of FIGS. 1-14 while such electrode pins are shown in FIGS. 15-16). The heating portion 50 extends along the lengthwise direction of the porous body, and is disposed in a position corresponding to the second porous portion 20. In other words, at least one portion of an extension length of the heating portion 50 along the lengthwise direction of the porous body is overlapped with an extension length of the second porous portion 20. As a result, efficiency of conductivity of liquid tobacco and a quantity of aerosol generation are enhanced. A practically connective way of the heating portion 50 and the second porous portion 20 can be either in such a way that the heating portion 50 is coil wound around an outer surface of the second porous portion 20 as shown in FIGS. 7-8, or in a similar way that the heating portion 50 is attached to an inner surface of the second porous portion 20 as shown in FIG. 2.

Figure 14:
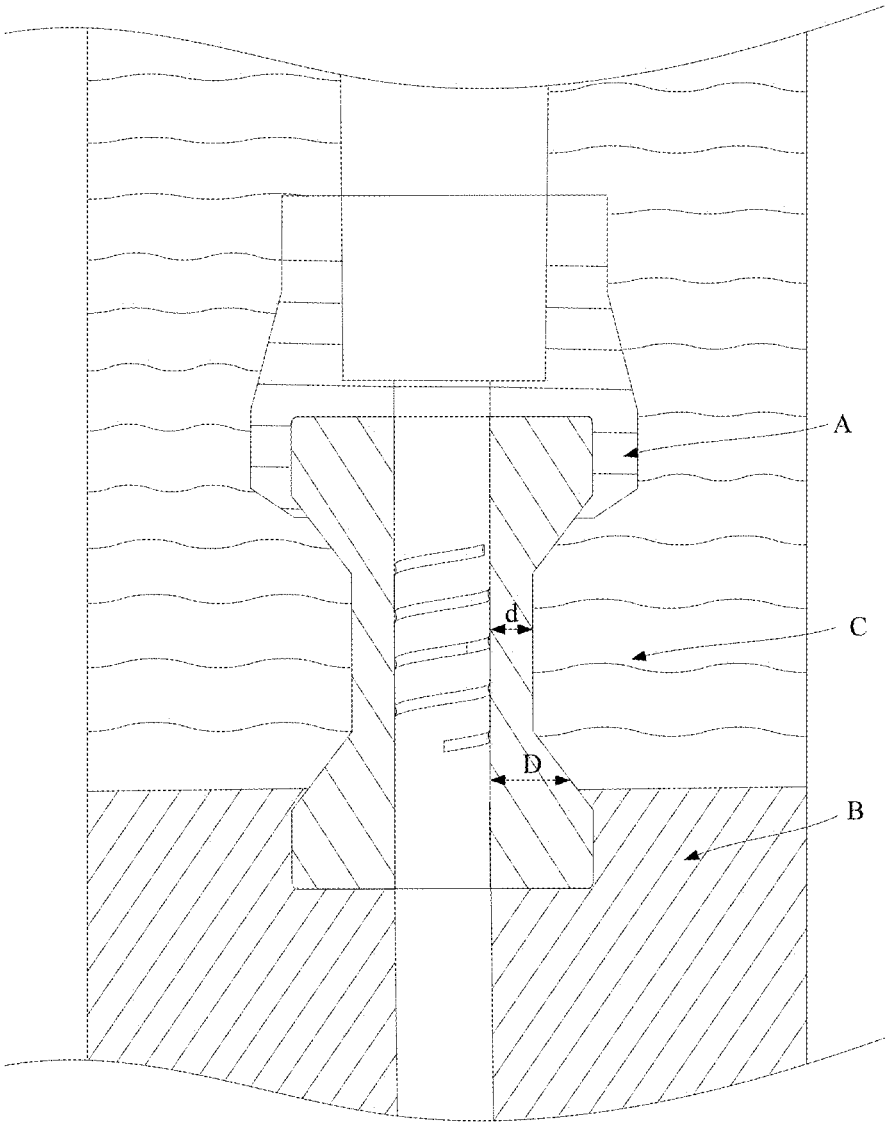
FIG. 14 shows a schematic cross-sectional view of the porous heating body of FIG. 12 shown to be installed in a liquid tobacco storage cavity of an atomizer in accordance with a preferred embodiment of the present invention.

Referring to FIG. 14, when the porous heating body is installed in a liquid tobacco storage cavity C, the above mentioned porous hearing body contributes to enhancement of conductivity of liquid tobacco and atomizing efficiency due to the following reason(s). The inner surface and the outer surface of the second porous portion 20 defined along a widthwise direction of the second porous portion 20 are respectively used as a liquid tobacco absorbing face a and an atomizing face b. In other words, the outer surface of the second porous portion 20 is defined as the liquid tobacco absorbing face a for contacting liquid tobacco. A surface of an inner wall of a through hole of the porous body is defined as the atomizing face b. The heating portion 50 is disposed on the atomizing face b. A shortest conductive distance d for liquid tobacco between the liquid tobacco absorbing face a and the atomizing face b along the widthwise direction of the second porous portion 20 is smaller than a conductive distance D for liquid tobacco between an outer surface of the first porous portion 10 or the third porous portion 30 and the surface of the inner wall of the through hole. Hence, in comparison with the first porous portion 10 and the third porous portion 30 at two ends of the porous body, the second porous portion 20 corresponding to the position of the heating portion 50 has higher liquid tobacco conductive efficiency. The first porous portion 10 and the third porous portion 30 at the two ends of the porous body are respectively shaped as two bulge ends. On the one hand, the first and third porous portions 10, 30 can have an effect to store liquid tobacco therein and to replenish liquid tobacco in the second porous portion 20 in a middle of the porous body due to liquid tobacco consumption of the second porous portion 20. As a result, liquid tobacco replenishing efficiency is enhanced when liquid tobacco in the second porous portion 20 is atomized. On the other hand, the shape of the porous body facilitates use of two fixing connective parts A, B as shown in FIG. 14 to respectively connect the two ends of the porous body. Fixation and sealing connection inside an atomizer are therefore conveniently achieved. Meanwhile, a volume of the first porous portion 10 or the third porous portion 30 are larger than a volume of the second porous portion 20. Heat generated by the heating portion 50 which is conducted toward the first and third porous portions 10, 30 can be absorbed by the first and third porous portions 10, 30 themselves. Therefore, heat conducted from the second porous portion 20 toward the above mentioned two fixing connective parts A, B respectively at its two ends along the lengthwise direction of the porous body can be reduced.

Furthermore, in the porous body as shown in drawings, the heating portion 50 can be a heating coil, a slice-shaped heating net or a cylindrical heating tube, etc. When the heating portion 50 is installed onto the porous body, the heating portion 50 is installed in a way that the heating portion 50 extends along the lengthwise direction of the porous body. Meanwhile, the heating portion 50 of the heating element corresponds to the second porous portion 20 along the widthwise direction of the porous body. In other words, at least a portion of the heating portion 50 is ensured to be overlapped with an extensive length of the second porous portion 20 along the lengthwise direction of the porous body in order to have a better atomizing efficiency for liquid tobacco.

Of course, the second porous portion 20 is column-shaped based on product structures and function requirements of usual shape specifications, preferable to be cylinder-shaped or prism-shaped, etc. The first porous portion 10 and the third porous portion 30 can also be adjusted in shapes correspondingly. For example, in an embodiment shown in FIG. 3, the first porous portion 10 and the third porous portion 30 is designed to be prism-shaped, and a through hole 40 is correspondingly disposed inside the porous body. An inner wall of the through hole 40 has two opposite atomizing faces. A first heating portion 50*a* and a second heating portion 50*b* are respectively disposed correspondingly onto the two atomizing faces. The first heating portion 50*a* and the second heating portion 50*b* are electrically connected with a power source assembly in parallel or in series.

Furthermore, the porous body of every embodiment shown in all drawings except FIG. 7 further has the through hole 40 successively penetrates the first porous portion 10, the second porous portion 20 and the third porous portion 30 along the lengthwise direction of the porous body based on requirements that the porous heating body needs to adapt to the need of internal atomization of the atomizer when the porous heating body is in use. The through hole 40 is disposed for the following functions and purposes. On the one hand, the through hole 40 is disposed to provide space for installation of the heating portion 50 such as a heating coil, a cylindrical heating tube or a heating wire, etc. On the other hand, the through hole 40 is used as a transferring channel of aerosol formed from liquid tobacco so that the aerosol formed from liquid tobacco via internal atomization is transferred to an aerosol channel of the atomizer.

Figure 4:
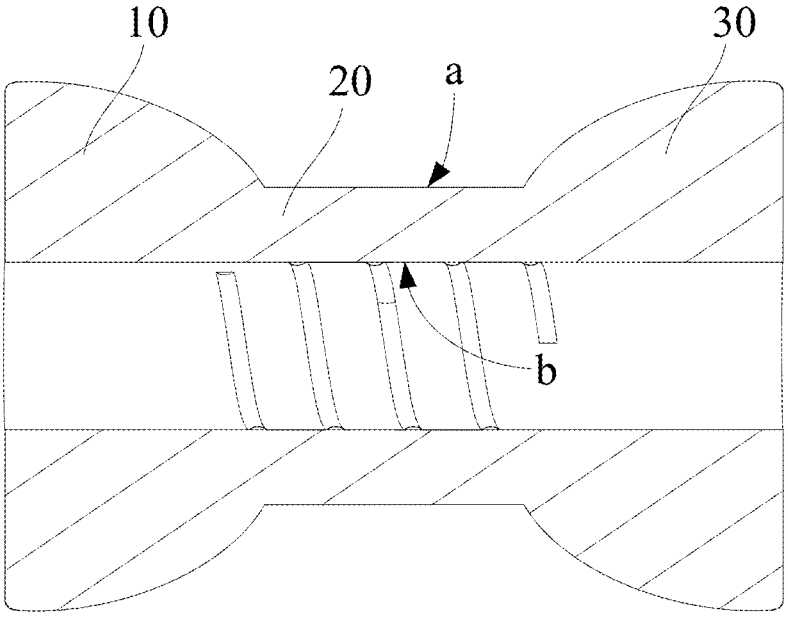
FIG. 4 shows a schematic cross-sectional view of a porous heating body along a lengthwise direction thereof in accordance with further another preferred embodiment of the present invention.
Figure 5:
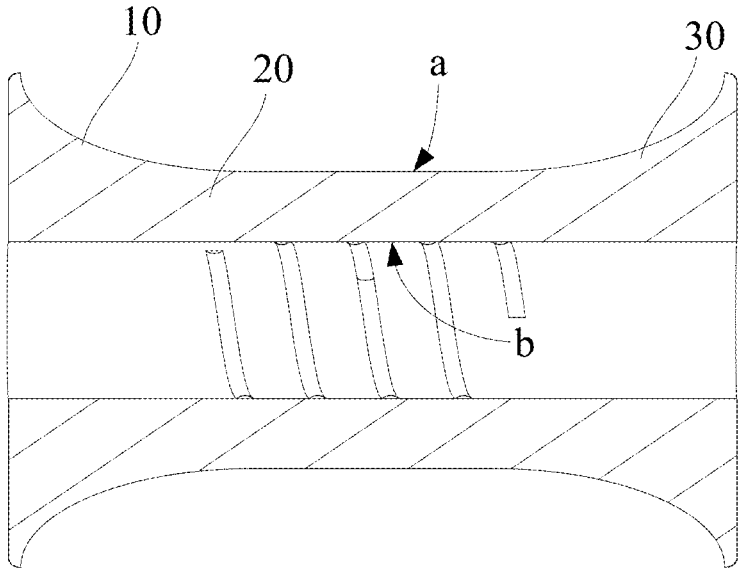
FIG. 5 shows a schematic cross-sectional view of a porous heating body along a lengthwise direction thereof in accordance with further another preferred embodiment of the present invention.
Figure 6:
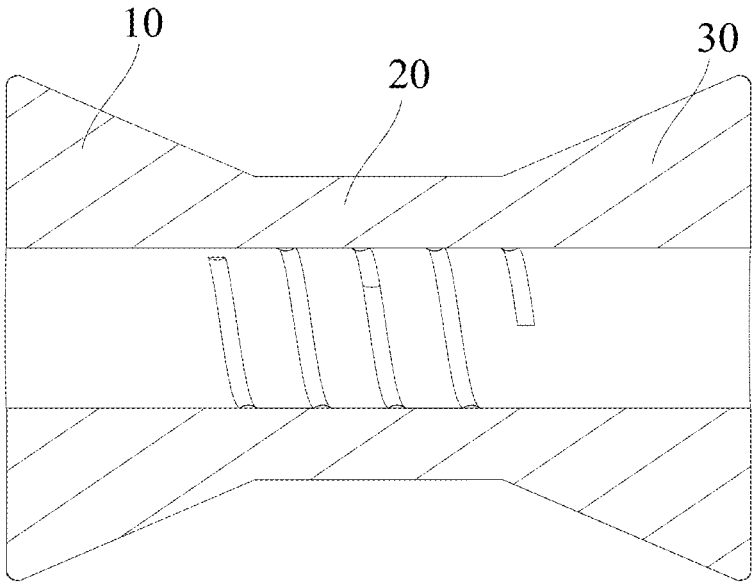
FIG. 6 shows a schematic cross-sectional view of a porous heating body along a lengthwise direction thereof in accordance with further another preferred embodiment of the present invention.

Furthermore, in the porous body in accordance with embodiments shown in FIGS. 4-6, the outer diameter of the first porous portion 10 along the widthwise direction of the porous body is gradually decreased along a forwarding direction of the lengthwise direction of the porous body toward the second porous portion 20. A transitional shape of the porous body via a shape design of the first porous portion 10 having a gradually decreased outer diameter transiting toward the second porous portion 20 facilitates wetting and conducting efficiencies of liquid tobacco from the two ends of the porous body toward the middle of the porous body, and facilitates enhancing quantity efficiency of generated aerosol and efficiency of generating aerosol. In a transitional design of the first porous portion 10 as depicted above, a surface of the first porous portion 10 is shaped to be tilted toward the second porous portion 20. Such shape usually adopts a plurality of design ways to proceed, such as a convex face as shown in FIG. 4, a concave face as shown in FIG. 5 or a flat face as shown in FIG. 6, etc.

Meanwhile, further referring to FIG. 6 to FIG. 13, in order to smoothly snugly fix the porous body with a silica gel seat inside an outer shell subsequently, the first porous portion 10 can be designed by sections. The sectional design, as shown in FIGS. 7-10, includes two sections, a first conductive section 11 and a second conductive section. The first and second conductive sections 11, 12 are successively disposed along a forwarding direction of a lengthwise direction of the porous heating body toward the second porous portion 20.

The first conductive section 11 is prism-shaped having a constant outer diameter. An outer diameter of the second conductive section 12 is gradually decreased along the forwarding direction of the lengthwise direction of the porous body toward the second porous portion 20. As a result, the sectional shape design has advantages that, in one way, the first conductive section 11 is used as the above mentioned two bulge ends for being conveniently installed with other parts, and in another way, the second conductive section 12 is transition-shaped to contribute enhancing wetting and conduction of liquid tobacco in the porous body.

Of course, in the above mentioned transitional designs, a surface of the second conductive section 12 can be shaped to be tilted toward the second porous portion 20. A variety of methods including using convex faces, concave faces, flat faces or any combination thereof respectively shown in FIGS. 6-13 can be adopted for design of the second conductive section 12.

Furthermore, the porous body can be made by porous material such as porous ceramics, porous glass ceramics, porous glass or foamed metal, etc. For example, the porous body can be made by hard capillarity structures such as beehive-typed ceramics made by material including aluminum oxide, silicon carbide or diatomaceous earth, etc.

In view of the above mentioned structure of the porous body, the third porous portion 30 exists correspondingly to the first porous portion 10. Hence, any structure and shape for the third porous portion 30 such as transitional tilting or separated sections are correspondingly designed to the first porous portion 10. The third porous section 30 can also adopt similar designs to the first porous portion 10 as mentioned above. Repeated descriptions for the third porous portion 30 is herein omitted.

Meanwhile, after the above porous body and the heating element is respectively acquired, the porous body and the heating element can be assembled to constitute the whole porous heating body according to the respectively drawings. In more embodiments and applications, raw material of the heating element can be directly sintered to form on a surface of the porous body. The sintering forming method includes the following steps. The raw material of the heating element (such as nickel metal powder) and a certain amount of sintering promoters are blended to form a blended slurry. The blended slurry is then painted on an inner surface or an outer surface of the porous body to form a printed layer via a method of smearing and brushing according to a required shape of the heating element. The heating element is therefore formed on the surface of the porous body after sintering. Alternatively, the heating element is a heating circuit disposed on the surface of the porous body. The heating circuit includes, but is not limited to, forms and styles such as a heating material painted layer and a resistance slurry printed circuit, etc. The porous body and the heating element are made as an integral structure to prevent the heating element from distortion or crack which affects heating performance of the heating element.

Figure 13:
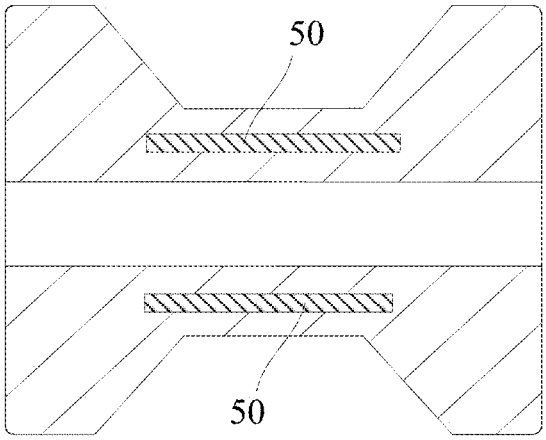
FIG. 13 shows a schematic cross-sectional view of a porous heating body along a lengthwise direction thereof in accordance with further another preferred embodiment of the present invention.

Besides, in addition to the above method to on disposed the surface of the porous body, the heating portion 50 of the heating element can be installed by using an internal embedment method as shown in FIG. 13. Liquid tobacco in the porous body does not need to be atomized after the liquid tobacco is conducted to a surface of the heating portion 50 for contact, but can be heated to be atomized inside portions of the porous body adjacent to a location of the heating portion 50. On the one hand, the heating portion 50 is in contact with the porous body for heat conduction to avoid dry heating. On the other hand, a majority of liquid tobacco is atomized without any direct contact with the heating portion 50 to avoid metal pollution generated from the heating element in aerosol.

Figure 17:
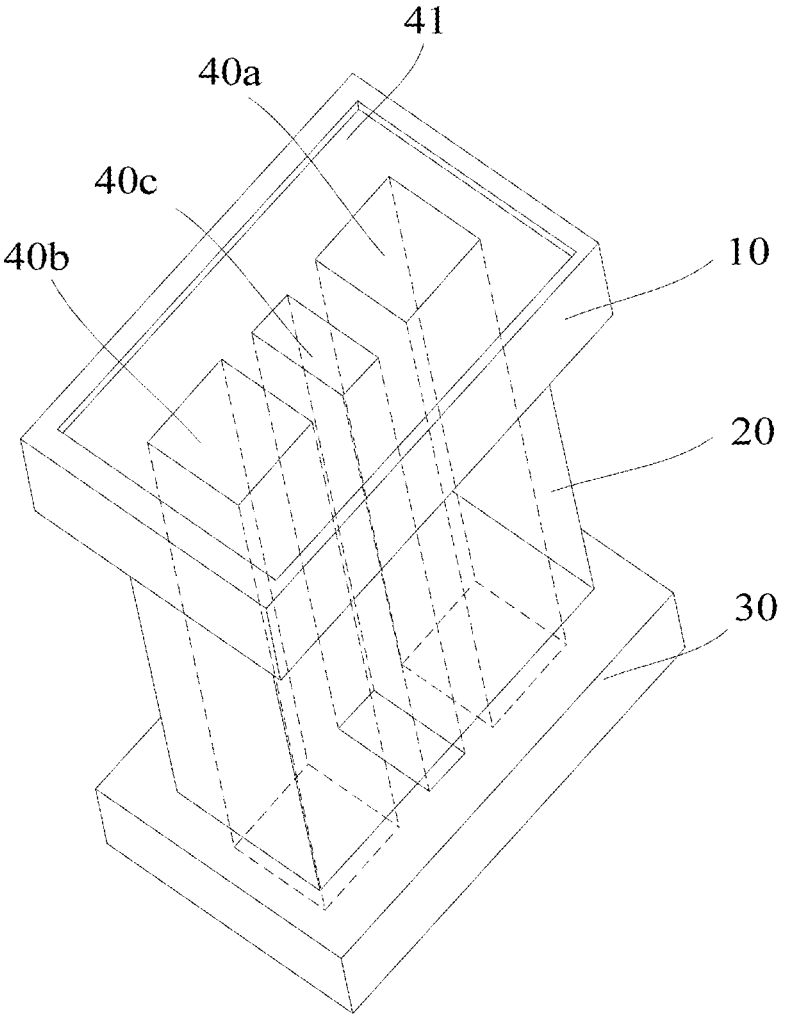
FIG. 17 shows a schematic perspective structural view of a porous heating body in accordance with further another preferred embodiment of the present invention.

On the basis of the same inventive idea, a porous heating body in accordance with a preferred embodiment of the invention is provided. A structure of the porous heating body in accordance with the preferred embodiment is shown in FIGS. 15-17. In comparison with the structure of the above preferred embodiment(s), a number of through holes inside the heating porous body is correspondingly increased, and the structure is correspondingly varied for design in combination with atomizing efficiency. The structure of the porous body includes two through holes successively penetrating the first porous portion 10, the second porous portion 20 and the third porous portion 30 along the lengthwise direction of the porous body. The two through holes are respectively a first through hole 40*a* and a second through hole 40*b*.

Referring to FIG. 15, a surface of the whole porous body is divided into four parts due to structural installation of the first through hole 40*a* and the second through hole 40*b*. The four parts are respectively a first inner face n of the first through hole 40*a*, a first outer face m corresponding to the first through hole 40*a*, a second inner face k of the second through hole 40*b*, and a second outer face j corresponding to the second through hole 40*b*.

With respect to two corresponding faces m, n for the first through hole 40*a*, the first inner face n can be set as an atomizing face while the first outer face m is correspondingly set as a liquid tobacco absorbing face, or the first inner face n can be set as a liquid tobacco absorbing face while the first outer face m is correspondingly set as an atomizing face, respectively according to design requirement(s). In other words, one of the two corresponding faces m, n is used for absorbing liquid tobacco, and the other of the two corresponding faces m, n is used for atomizing. In the meantime, the heating portion 50 is disposed on the set atomizing face (the heating portion 50 can be embedded inside the atomizing face, or be attached to the atomizing face). For example, as shown in FIG. 16, a first heating portion 50*a* is disposed on the first inner face n when the first inner face n is set as the atomizing face. In addition, two corresponding faces k, j for the second through hole 40*b* can be correspondingly set to respectively have one of the two corresponding faces k, j being used for absorbing liquid tobacco, and the other of the two corresponding faces k, j is used for atomizing. A second heating portion 50*b* is correspondingly disposed on the atomizing face.

Of course, it is required to explain that embodiment(s) shown in FIGS. 15-16 is a preferred design when a number of through holes are two. In other varied embodiment(s), when a volume of the porous body is sufficient, the number of through holes can be increased to 3, 4 or more. The heating portion 50 is correspondingly disposed therein to allow the porous heating body having faster conduction of liquid tobacco and atomizing efficiency. In the meantime, a setting of the atomizing face and the liquid tobacco absorbing face as shown in FIG. 16 can be reversed. The first outer face m and the second outer face j are respectively set as atomizing faces, and the first inner face n and the second inner face k are respectively set as liquid tobacco absorbing faces. The first heating portion 50*a* and the second heating portion 50*b* are adjusted to be respectively disposed at locations adjacent to the first outer face m and the second outer face j. The installation method for the heating portion 50 attached to the outer surface of the porous body can be a similar method of surface attachment as shown in FIGS. 7-8, or a method of surface internal embedment (These methods can be easily understood and practiced by technical personnel in the art, and therefore detailed illustrations with drawings are omitted).

In practice, the first heating portion 50*a* and the second heating portion 50*b* can also be formed on the porous body via the above manufacturing process such as sintering, printing, coating and etching, etc.

Meanwhile, the porous body further includes the first through hole 40*a* and the second through hole 40*b* both of which are spatially communicated with an aerosol mixing room 41 at the same time. Aerosol of liquid tobacco respectively generated from the first through hole 40*a* and the second through hole 40*b* is gathered and mixed in the aerosol mixing room 41 along a conductive direction of aerosol, and then is output to an aerosol conductive tube of the atomizer from the aerosol mixing room 41. Two or more extensive functions can be achieved via the aerosol mixing room 41. On the one hand, the aerosol mixing room 41 is used as a mixing space for aerosol of liquid tobacco, and has a function to conduct flow of aerosol and to output aerosol collectively when aerosol is separately distributed in respective through holes. On the other hand, a favor of aerosol can be further adjusted through the aerosol mixing function of the aerosol mixing room 41. In practice, the first heating portion 50*a* and the second heating portion 50*b* can be set to work under different heating temperatures from each other. For example, a heating temperature of the first heating portion 50*a* is set to be lower than a heating temperature of the second heating portion 50*b*. In liquid tobacco (Ingredients of liquid tobacco, except nicotine, further mainly include vegetable glycerin, propylene glycol and essences), essence ingredients have a low boiling point, vegetable glycerin has a high boiling point and propylene glycol has a boiling point between them. When the heating temperature of the first heating portion 50*a* is set to be lower than the heating temperature of the second heating portion 50*b*, essence favor of aerosol generated from the first through hole 40*a* is heavier than essence favor of aerosol generated from the second through hole 40*b*, and vegetable glycerin ingredients in the aerosol generated from the first through hole 40*a* is less than vegetable glycerin ingredients in the aerosol generated from the second through hole 40*b*. A favor of mixed aerosol can be different from respective favors generated from respective through holes via different heating powers set for the heating element. Furthermore, final users can inhale more aerosol with different favors according to more various controls of the first heating portion 50*a* and the second heating portion 50*b* to work respectively under different output electrical powers of a power source.

Furthermore, the first through hole 40*a* and the second through hole 40*b* both adopting a cylindrical hole as shown in FIG. 15 are exemplified for illustrations of a shape design of the outer surface of the porous body. The first outer face m corresponding to the first through hole 40*a* and the second outer face j corresponding to the second through hole 40*b* are both shaped as a longitudinal circular curve face disposed respectively coaxially with the first and second through holes. As a result, a distance between every point on the first outer face m and a corresponding point on the first inner face n is constant along a radial direction of the first through hole 40*a*. Besides, a distance between every point on the second outer face j and a corresponding point on the second inner face k is constant along a radial direction of the second through hole 40*b*. The shape design of the outer surface of the porous body is adopted to make respective through holes having a uniform and steady conductive speed for liquid tobacco.

Besides, a recess 22 is formed at a joint between the first outer face m and the second outer face j. The recess 22 is set to facilitate conduction of liquid tobacco toward a middle portion f between the first through hole 40*a* and the second through hole 40*b*. The shortcoming of slow conduction of liquid tobacco in a conventional design when a thickness of the middle portion f between the first through hole 40*a* and the second through hole 40*b* is larger than a thickness of either one of two lateral portions e can be easily solved by the present invention.

Figure 3:
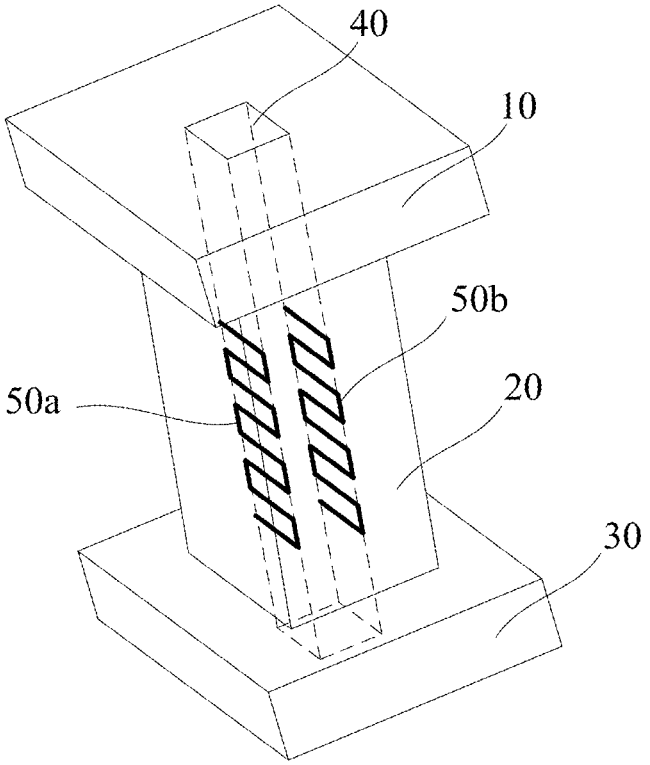
FIG. 3 shows a schematic perspective structural view of a porous heating body in accordance with further another preferred embodiment of the present invention.

Meanwhile, on the basis of the first through hole 40*a* and the second through hole 40*b* both adopting a cylindrical hole, the first through hole 40*a* and the second through hole 40*b* can also adopt a prism hole as shown in embodiments of FIG. 3. A shape design of the structure of the porous body using prism holes is referred to FIGS. 17-18. Two ways respectively shown in FIGS. 17-18 are illustrated to ensure conduction of liquid tobacco on respective atomizing faces when inner walls of a through hole are set to be the atomizing faces for installation of the heating portions.

The first through hole 40*a* with a tetrahedron shape in the porous body forms four inner walls. The first heating portion 50*a* and the second heating portion 50*b* are respectively oppositely disposed on two opposite inner walls out of the four inner walls and respectively extend along an axial direction of the first through hole 40*a*. The opposite pair of an inner wall L1 and an inner wall L2 where the first heating portion 50*a* and the second heating portion 50*b* are respectively located are respectively parallel to and face toward an outer face L3 and an outer face L4 oppositely located on the outer surface of the second porous portion 20. The inner wall L1 and the outer face L3, and the inner wall L2 and the outer face L4 are respectively set as atomizing faces and liquid tobacco absorbing faces. A conductive distance of liquid tobacco is uniform and constant in the above design to ensure a uniform and steady conductive speed for liquid tobacco.

Figure 18:
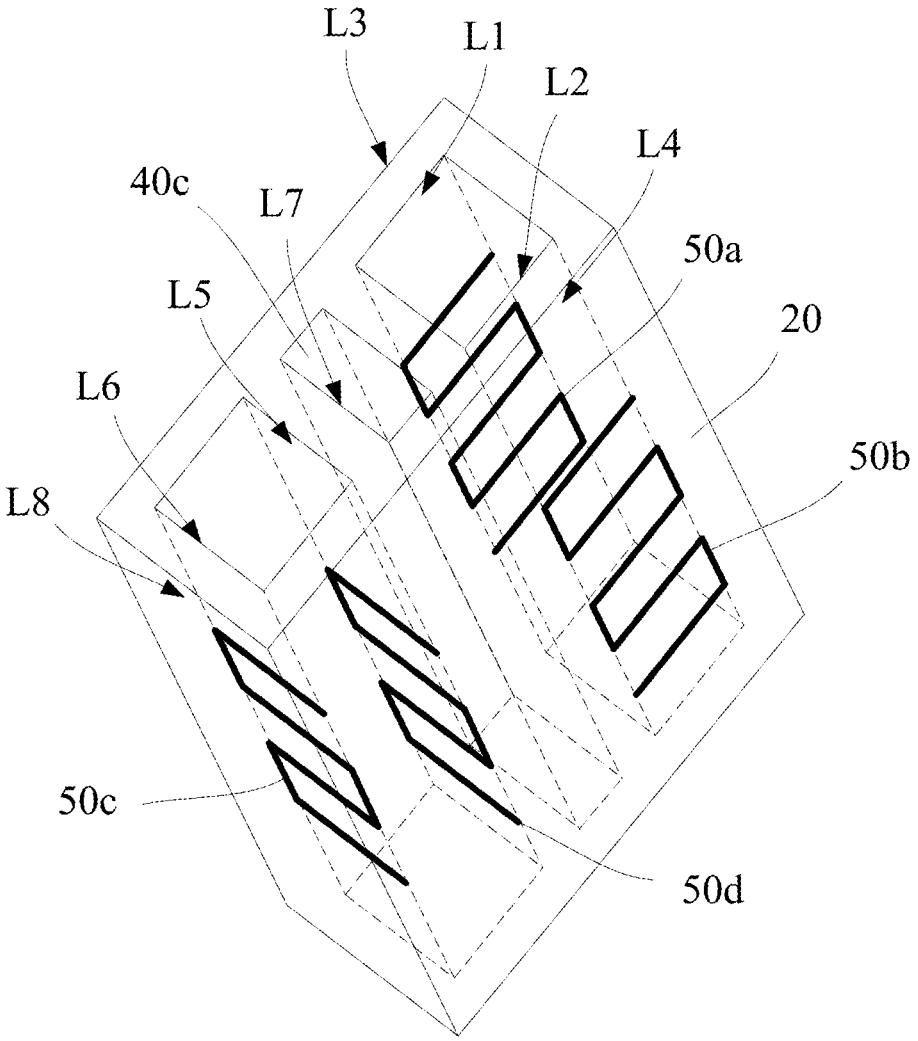
FIG. 18 shows a schematic cross-sectional view of a second porous portion of the porous heating body of FIG. 17 installing a heating portion therein in accordance with the further another preferred embodiment of the present invention.

A third heating portion 50*c* and a fourth heating portion 50*d* are respectively located on an inner wall L5 and an inner wall L6 of the second through hole 40*b* as shown in FIG. 18. The inner wall L6 is parallel to and faces oppositely to an outer face L8. Hence, when the inner wall L6 is set as an atomizing face, the outer face L8 is set as a liquid tobacco absorbing face so that fine conduction of liquid tobacco can be achieved. As to the inner wall L5, the outer surface of the porous body cannot be used correspondingly to the inner wall L5 for fine conduction of liquid tobacco. A third through hole 40*c* can be further disposed inside the porous body, and is only disposed and used for absorbing liquid tobacco. An inner wall L7 located in the third through hole 40*c* is opposite to the inner wall L5 of the second through hole 40*b*. The inner wall L7 is correspondingly set as a liquid tobacco absorbing face when the inner wall L5 is set as an atomizing face. In respective situations as above, a conductive distance of liquid tobacco from the liquid tobacco absorbing face to the atomizing face is uniform and constant. As a result, a uniform and steady conductive speed of liquid tobacco is ensured, and the porous heating body generates aerosol fine and soundly.

It is required to explain that the heating portions in the above respective embodiments (such as the first heating portion 50*a*, the second heating portion 50*b*, the third heating portion 50*c* and the fourth heating portion 50*d* as above) can respectively be equipped with electrode pins to constitute respective independent heating elements. The respective heating portions can also belong to a single heating element, and are electrically connected in parallel or in series when being installed to finally share a set of pins for power supply.

According to the above structural design, the second porous portion 20 has a liquid tobacco working face (i.e., the liquid tobacco working face can be used for one action out of atomizing liquid tobacco and contacting liquid tobacco, and according to the above description of the third through hole 40*c*, the liquid tobacco working face is not limited to be formed by the surfaces of the second porous portion 20) corresponding to an inner wall of the first through hole 40*a* or the second through hole 40*b*. A distance between the inner wall of the first through hole 40*a* or the second through hole 40*b* and a corresponding liquid tobacco working face along respective radial directions of the first through hole 40*a* or the second through hole 40*b* is same. When the liquid tobacco working face and the inner wall of the first through hole 40*a* or the second through hole 40*b* are respectively set as the atomizing face and liquid tobacco absorbing face, uniform and fine conduction of liquid tobacco and efficiency of steady generation of aerosol for the porous body can be both achieved.

Of course, a structure of the third through hole 40*c* can also be omitted to be disposed in the second porous portion 20. Based on use requirement(s) for high conduction rate of liquid tobacco and high generation rate of aerosol, the heating portion can be disposed on any inner walls other than the inner wall L5. Alternatively, if there is not requirement(s) for high conduction rate of liquid tobacco and high generation rate of aerosol and the second porous portion 20 does not have the structure of the third through hole 40*c*, liquid tobacco atomized at the inner wall L5 is conducted from other locations of the second porous portion 20 via travelling a longer distance, and therefore its efficiency of conduction of liquid tobacco and aerosol generation is just a little poor.

Based on the above, when a shape of a through hole can be varied to other shapes such as a polyhedron, etc., or a number of through holes can be increased to three, four or more, a liquid tobacco working face having a constant distance between the liquid tobacco working face and a corresponding inner wall of a through hole is formed by using the surface of the second porous portion 20 or by adding attachment structures onto the second porous portion 20. The liquid tobacco working face and the corresponding inner wall of the through hole are respectively set as the atomizing face and liquid tobacco absorbing face to ensure a uniform and steady conductive speed of liquid tobacco and fine aerosol generation for the porous heating body.

The above porous heating body in accordance with the present invention is adopted to have advantages as follows. A middle of the porous body has a relatively shorter conductive distance for liquid tobacco to facilitate enhancing conductivity of liquid tobacco through the porous body being changed to be shaped as a dumbbell when liquid tobacco is atomized. The two bulge ends of the porous body, on the one hand, can have an effect to store liquid tobacco therein and to replenish liquid tobacco in the middle of the porous body due to liquid tobacco consumption thereof. As a result, liquid tobacco replenishing efficiency is enhanced when liquid tobacco in the middle of the porous body is atomized. On the other hand, the shape of the porous body facilitates fixation and sealing connection of the porous body with other parts being conveniently achieved. Meanwhile, the porous body in accordance with the present invention can reduce heat dissipation of generated heat therein toward an external environment.

Based on the above mentioned content regarding the porous heating body, a product of an atomizer includes the above mentioned porous heating body in accordance with the present invention is further provided. A structure of the atomizer can be exemplified by a flat electronic cigarette for detailed illustrations. The exemplified structure can be referred to an embodiment shown in FIG. 19.

Figure 19:
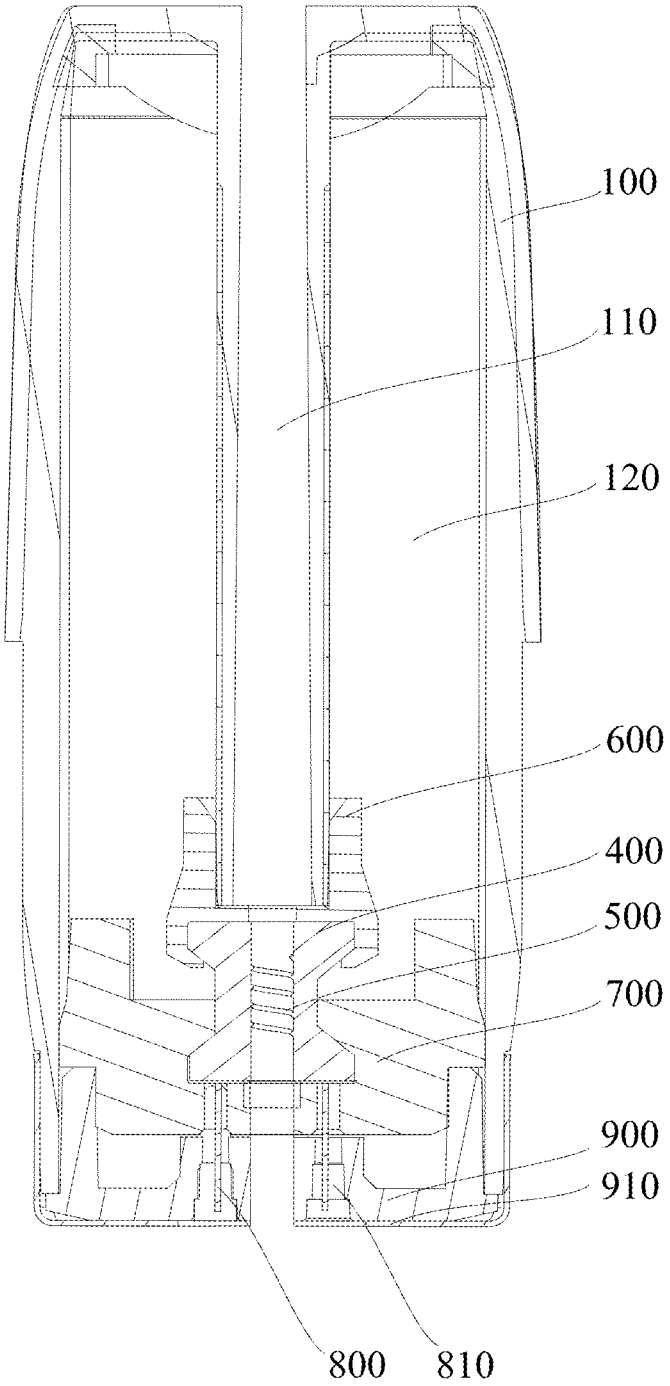
FIG. 19 shows a schematic cross-sectional view of an atomizer along an axial direction thereof in accordance with a preferred embodiment of the present invention.

The structure of the atomizer as shown in FIG. 19 includes a hollow outer shell 100. An outline of the outer shell 100, according to shape requirements of different products, can be designed as regular geometric cylindrical shapes (such as a circular cylinder shape, a prism tube shape, etc.), or a flat shape having a thickness size of the flat shape smaller than a width size of the flat shape as shown in FIG. 19. The hollow outer shell 100 has an opening at a lower end of the outer shell 100. The opening is designed for use to refill liquid tobacco and to conveniently install necessary atomizing structures, such as the above mentioned porous heating body 400, a sealing piece, a bottom seat or electrode terminals, etc., inside the hollow outer shell 100.

An aerosol conductive tube 110 is disposed inside the outer shell 100 along an axial direction of the outer shell 100 to conduct aerosol atomized from liquid tobacco. Hence, based on usual designs of electronic cigarette products, the aerosol conductive tube 110 has an upper end opening used as a suction nozzle for user inhaling, and a lower end connected with an atomizing assembly. As a result, aerosol atomized from liquid tobacco and generated by the atomizing assembly can be conducted toward smoker for inhaling through the aerosol conductive tube 110. Meanwhile, a liquid tobacco storage cavity 120 used for storing liquid tobacco is formed in a hollow portion between an outer wall of the aerosol conductive tube 110 and the outer shell 100.

It is understood as shown in drawings, a porous heating body 400 is installed at the lower end of the aerosol conductive tube 110. The porous heating body 400 can adopt the porous heating body shaped as a dumbbell and having a through hole therein as shown in an embodiment of FIG. 12. A heating element is installed inside the porous heating body 400. The heating element has a heating portion 500 extending along an axial direction of the porous heating body 400. Meanwhile, the porous heating body 400 and the aerosol conductive tube 110 are coaxially installed during installation of the atomizer to ensure significantly smooth connection between the through hole in a middle of the porous heating body 400 and the aerosol conductive tube 110. Besides, in order to ensure subsequent connection of the heating portion 500 with a power source assembly of an electronic cigarette to perform electrically heating, the heating element further has electrically conducting pins 800 respectively disposed at two ends of the heating portion 500. Two electrode terminals 810 are installed on a plastic end cover 900. The electrically conducting pins 800 are correspondingly respectively soldered onto or connected in contact with the two electrode terminals 810. As a result, the two electrode terminals 810 are conveniently respectively electrically connected with positive and negative electrodes of the power supply assembly after the atomizer is assembled with the power supply assembly in order to power the heating portion 500.

In the meantime, a silica gel seat 700 is disposed at a lower end of the liquid tobacco storage cavity 120 along the axial direction of the outer shell. The silica gel seat 700 is used to seal the lower end of the liquid tobacco storage cavity 120 in order for avoiding leakage of liquid tobacco.

At the same time, the plastic end cover 900 is further disposed at the opening of the lower end of the outer shell 100 in order to cover and seal the opening of the lower end of the outer shell 100. Technical personnel in the art can design and adopt variously different shapes and connections of the plastic end cover 900 based on design purposes of the plastic end cover 900. Meanwhile, a stainless steel shell 910 is further disposed at the lower end of the hollow outer shell 100 to cover the lower end and a portion of an outer surface of the outer shell 100. The stainless steel shell 910 can be used, on the one hand, to strengthen steady installation of inner parts of the atomizer, and on the other hand, to facilitate aesthetic feeling about an outer shape of products due to effect of metal color.

Figure 12:
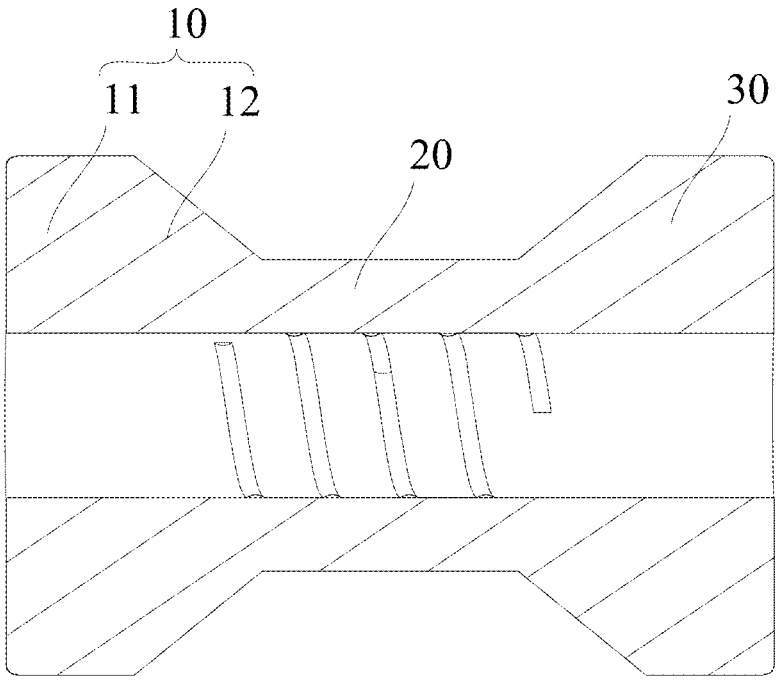
FIG. 12 shows a schematic cross-sectional view of the porous heating body of FIG. 1 along a lengthwise direction thereof in accordance with further another preferred embodiment of the present invention.
Figure 20:
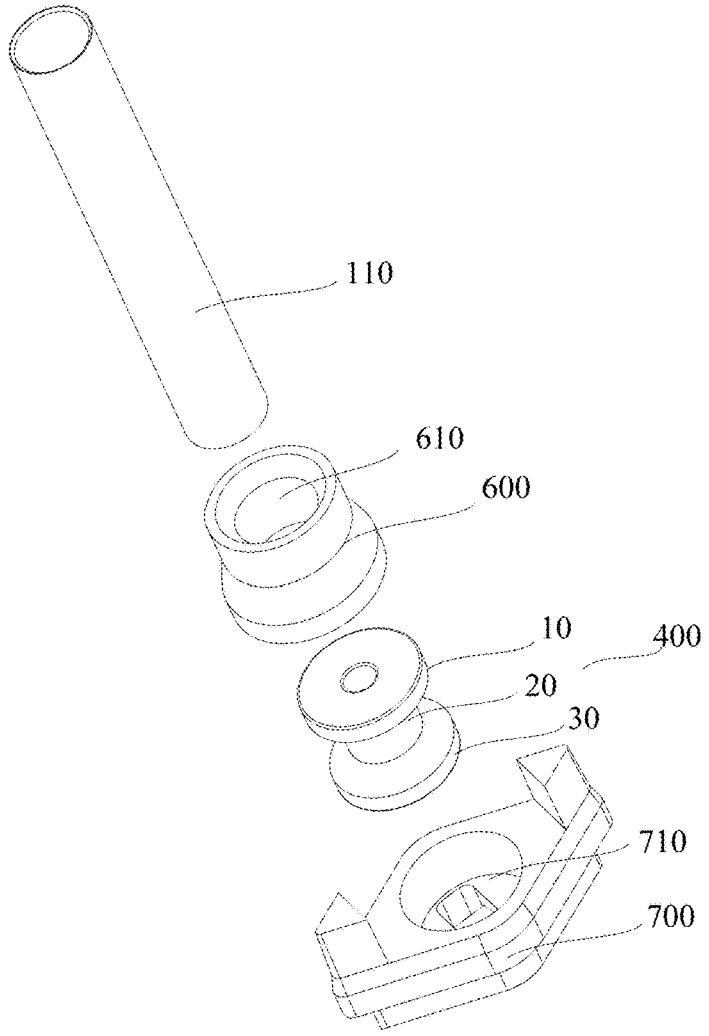
FIG. 20 shows a schematic perspective exploded view of parts of an assembling structure of the atomizer of FIG. 19 for installing a porous heating body in accordance with the preferred embodiment of the present invention.
Figure 21:
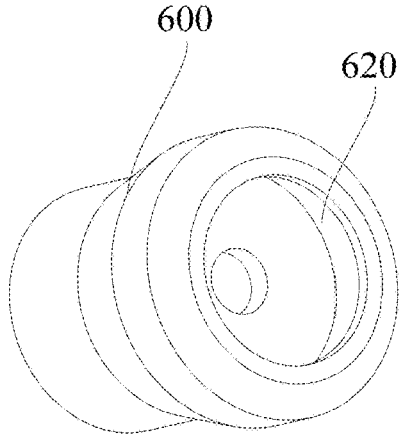
FIG. 21 shows a schematic perspective view of a silica gel connective piece of FIG. 20 viewed from another viewing angle in accordance with the preferred embodiment of the present invention.

Based on the above structure, installation and fixing of the porous heating body 400 in accordance with the present invention in a conventional atomizer product become much inconvenient. In view of the above shortcoming, the atomizer in accordance with an embodiment of the present invention provides a corresponding design of installing structures to fix and hermetically seal the porous heating body 400 according to shape characteristics of the porous heating body 400 shaped as a dumbbell. The installing and connecting structure can be referred to FIGS. 19-21. A silica gel connective piece 600 and the silica gel seat 700 are commonly used to perform and achieve as the installing and connecting structure. The porous heating body as shown in an embodiment of FIG. 12 is exemplified for illustrations of fixing and installation of the porous heating body 400.

The silica gel connective piece 600 is used to connect the aerosol conductive tube 110 with the porous heating body 400. Again, the porous heating body 400 is shaped as a dumbbell, and includes the first porous portion 10, the second porous portion 20 and the third porous portion 30 successively coaxially disposed in the porous heating body along the lengthwise direction of the heating porous body. Meanwhile, the outer diameter of the first porous portion 10 and the outer diameter of the third porous portion 30 are both larger than the outer diameter of the second porous portion 20.

Based on bulge shapes of the first porous portion 10 and the third porous portion 30 in comparison with the second porous portion 20, a first accommodating portion 710 for accommodating the third porous portion 30 is disposed on the silica gel seat 700. A second accommodating portion 620 for accommodating the first porous portion 10 is disposed on the silica gel connective piece 600.

Furthermore, the third porous portion 30 has a transitional outer surface with a gradually decreased outer diameter. The first accommodating portion 710 is shaped to mate with the third porous portion 30, and can be interferingly connected with the third porous portion 30 due to shape mating. As to the second accommodating portion 620, the second accommodating portion 620 can also be shaped to mate with the first porous portion 10 in order to be interferingly connected with the first porous portion 10. The above mentioned method of interferingly accommodating can be obviously viewed referring to the schematic cross-sectional view of FIG. 19. Meanwhile, the silica gel connective piece 600 and the silica gel seat 700 are both made of flexible material of silica gel for facilitating assembly.

The silica gel connective piece 600 further includes a connective portion 610 to connect with the aerosol conductive tube 110. Referring to embodiments of FIGS. 19-20, the connective portion 610 is designed as an insertable slot to mate with a shape of the aerosol conductive tube 110. When assembling for connection, a lower end of the aerosol conductive tube 110 is inserted into the insertable slot for steady interference fit to form hermitic connection. It is required to explain that the connective portion 610 can further be designed as any frequently used connective method for tube-like structures such as hook buckles, tube clips and insertion pins, etc. Of course, technical personnel in the art can easily acquire the above structures, and therefore detailed illustrative exemplification is hereby omitted.

The silica gel connective piece 600 and the silica gel seat 700 are respectively designed to form the first and second accommodating portions 710, 620 corresponding to the shape of the porous heating body 400 with two bulge ends and to mate with the two bulge ends. As a result, fixing installation of the porous heating body 400 can be achieved and a better hermitic effect is accomplished after assembly of the porous heating body 400.

Meanwhile, in order to further ensure requirement for smooth airflow of air-aerosol circulation, the silica gel connective piece 600 further includes an aerosol airflow passing hole formed therein. One end of the aerosol airflow passing hole is connectively communicated with the lower end of the aerosol conductive tube 110, and the other end of the aerosol airflow passing hole is connectively communicated with the axially directional through hole 40 of the porous heating body 400. According to existing technical methods, the silica gel seat 700 includes an intake hole to ensure entry of external air and achieve smooth airflow circulation inside the atomizer.

Meanwhile, the silica gel seat 700 itself is required to be fixed when the silica gel seat 700 is used as a fixing base of the porous heating body 400. As shown in FIG. 19 of the drawings, the silica gel seat 700 is fixed by a plastic end cover 900 pressingly engaging and/or by an inner wall of the outer shell 100 fixedly engaging. Alternatively, when the plastic end cover 900 and the outer shell 100 are integrally formed in other atomizer types, an engaging portion used to engage or install the silica gel seat 700 can be treated to be disposed inside the integral outer shell 100, and the silica gel seat 700 is therefore fixedly engaged with the engaging portion for installation.

In the above embodiments, an outer surface of the porous heating body 400 of the atomizer can be wrapped with a layer of cellucotton or non-woven fabric. The wrapped layer is used to prevent powders dropped from the porous heating body 400 made by material such as ceramic, etc., due to the porous heating body 400 being immersed in liquid tobacco for a long time from blending in aerosol to affect inhaling mouthfeel.

The above embodiment(s) is exemplified to fixedly install the porous heating body as shown in FIG. 12. The varied multiple-through-hole porous heating body as shown in FIGS. 15-18 can be installed by using the above same structures.

Atomizers adopting the above embodiments in accordance with the present invention are correspondingly equipped with connective and assembling parts made by silica gel material in view of the porous heating body having two bulge ends to correspondingly connect and install the porous heating body for convenient installation and sealing. In the meantime, the dumbbell shaped structure of the porous heating body contributes to enhancing conductivity of liquid tobacco in the middle thereof. As a result, after the heating element is installed at the middle of the porous heating body, quantity and efficiency of aerosol generation of the present invention can be extremely enhanced.

Based on the above structures and the idea to enhance the whole porosity and aerosol generation, a manufacturing method to made the porous body having higher conductivity of liquid tobacco and higher efficiency of aerosol generation in accordance with the present invention is further provided. The method includes the following.

In a step of S10, raw material consisting of the following ingredients based on respective mass percentages is acquired. The ingredients include 50%~75% of diatomite, 0%~10% of aluminum oxide, 15%~35% of pore formers, 5%~10% of clay and 5%~15% of glass powders.

In a step of S20, the above ingredients are uniformly blended with paraffin to form a paraffin lump of raw material.

In a step of S30, the acquired paraffin lump of raw material from the step of S20 is pressed in pressure based on a required shape of final products to form a rough blank.

In a step of S40, the rough blank is firstly kept warmth under a temperature of 200° C.~500° C. for 4~10 hours, and then is sintered under a temperature of 700° C.~1,200° C. for 2~4 hours to acquire the porous body.

In the above manufacturing processes in accordance with the present invention, ingredients are characteristically assorted and selected as the raw material to make the porous body in the step of S10. Diatomite is used as a main ceramic material, and a pore former is used for forming pores in a sintering process. Glass powders and aluminum oxide are used for adjusting and changing properties of the porous body such as rigidity and hardness, etc. Finally, a much proper porous body can be formed based on the above assorting and selection. The pore former is selected from at least one kind of sucrose, amylum, wood fiber and short carbon fiber. Complex organic or inorganic substances with large particle diameters, such as sucrose, amylum, wood fiber and short carbon fiber, are adopted as pore formers to control pore diameters and porosity of finally formed porous ceramics based on requirement(s). A spatially communicative through-pore structure adaptive for storage and conduction of liquid tobacco and aerosol generation is therefore acquired.

Glass powders in use are preferably high-temperature glass powders (a melting point thereof is 800° C. to 1,300° C.) rather than low-temperature glass powders (a melting point thereof is 320° C. to 600° C.) based on bonding of respective ingredients in the final sintering process and property requirement(s) of a final product of the porous body.

In the step of S20, paraffin is used as an adhesive agent for shaping. Respective ingredients are blended and adhered via paraffin to form the paraffin lump of raw material, and a following sintering process is then performed on the paraffin lump of raw material. In details, in the step of S20, respective ingredients acquired in the step of S10 are firstly blended into a mixed powder body. Paraffin is then melt into its liquid state under a temperature of 80° C. The mixed powder body is then poured in the liquid paraffin followed by stirring and cooling at the same time. The mixed powder body and paraffin are therefore uniformly wrapped with each other to form the paraffin lump of raw material.

In the step of S30, the paraffin lump of raw material is further pressed in pressure for shaping to form a preliminary shape of the final product. In the pressing process, a pressing machine is adopted for processing. In details, the paraffin lump of raw material is converted into a paraffin slurry under a temperature of 70° C.~85° C. and a pressure of 0.4 MPa~1 MPa, and then the paraffin slurry is poured into molds to form the shaped rough blank of the porous body with a required shape.

A sintering process of the step of S40 is divided into two sub-steps. The rough blank is firstly degreased to remove paraffin adhesives in a body of the rough blank under a temperature of 200° C.~500° C. The degreased rough blank is then sintered under an adjusted temperature of 700° C.~1,200° C. to acquire the porous body with the required shape, porosity and pore diameter.

Meanwhile, some processing steps of detailed treatments to enhance quality of the porous body can be added in the above respective steps in order for better manufacturing final quality.

Before the step of S20, the following is added.

In a step of S11, diatomite, aluminum oxide, pore formers, clay and glass powders based on the above percentages are poured into a planetary activator for wet ball grinding for 5 hours. Deionized water or absolute ethanol is used as ball grinding agents. Ball grinding is adopted to make respective ingredients mixed more uniformly for acquiring a uniformly mixed powder body.

In order to facilitate understanding and practice of technical personnel in the art for details of the above manufacturing method of the porous body in accordance with the present invention, and to outstandingly show progressive effect in performance and quality of the porous body manufactured by the method in accordance with the present invention, the following embodiments are exemplified to illustrate the content of the above method.

Embodiment 1

In the step of S10, raw material consisting of the following ingredients based on respective mass percentages is acquired. The ingredients include 70 g of diatomite, 3 g of aluminum oxide, 15 g of a wood fiber pore former, 5 g of clay and 7 g of high-temperature glass powders.

In the step of S11, respective ingredients acquired in the step of S10 are poured into the planetary activator for wet ball grinding for 5 hours. Deionized water is used as ball grinding agents. A uniformly mixed powder body is acquired.

In the step of S20, a proper quantity of paraffin is melt into its liquid state under a temperature of 80° C. The mixed powder body acquired in the step of S11 is then poured in the liquid paraffin followed by stirring and cooling at the same time. The mixed powder body and paraffin are uniformly wrapped with each other to form the paraffin lump of raw material.

In the step of S30, the paraffin lump of raw material is placed in the pressing machine under a controlled temperature of 70° C. and a controlled pressure of 0.4 MPa, and then the paraffin slurry is poured into molds corresponding to a shape of embodiments of the porous body as shown in FIG. 1 to form the shaped rough blank of the porous body.

In the step of S40, the rough blank is firstly kept warmth under a temperature of 200° C. for 10 hours, and then is sintered under a temperature of 700° C. for 4 hours to acquire the sintered porous body.

Embodiment 2

In a step of S10, raw material consisting of the following ingredients based on respective mass percentages is acquired. The ingredients include 65 g of diatomite, 25 g of a sucrose pore former, 5 g of clay and 5 g of high-temperature glass powders.

In the step of S11, respective ingredients acquired in the step of S10 are poured into the planetary activator for wet ball grinding for 4 hours. Absolute ethanol is used as ball grinding agents. A uniformly mixed powder body is acquired.

In the step of S20, a proper quantity of paraffin is melt into its liquid state under a temperature of 80° C. The mixed powder body acquired in the step of S11 is then poured in the liquid paraffin followed by stirring and cooling at the same time. The mixed powder body and paraffin are uniformly wrapped with each other to form the paraffin lump of raw material.

In the step of S30, the paraffin lump of raw material is placed in the pressing machine under a controlled temperature of 85° C. and a controlled pressure of 1 MPa, and then the paraffin slurry is poured into molds corresponding to a shape of embodiments of the porous body as shown in FIG. 1 to form the shaped rough blank of the porous body.

In the step of S40, the rough blank is firstly kept warmth under a temperature of 500° C. for 4 hours, and then is sintered under a temperature of 1,200° C. for 2 hours to acquire the sintered porous body.

Embodiment 3

In a step of S10, raw material consisting of the following ingredients based on respective mass percentages is acquired. The ingredients include 58 g of diatomite, 5 g of aluminum oxide, 20 g of a sucrose pore former, 5 g of clay and 12 g of high-temperature glass powders.

In the step of S11, respective ingredients acquired in the step of S10 are poured into the planetary activator for wet ball grinding for 4 hours. Absolute ethanol is used as ball grinding agents. A uniformly mixed powder body is acquired.

In the step of S20, a proper quantity of paraffin is melt into its liquid state under a temperature of 80° C. The mixed powder body acquired in the step of S11 is then poured in the liquid paraffin followed by stirring and cooling at the same time. The mixed powder body and paraffin are uniformly wrapped with each other to form the paraffin lump of raw material.

In the step of S30, the paraffin lump of raw material is placed in the pressing machine under a controlled temperature of 80° C. and a controlled pressure of 0.8 MPa, and then the paraffin slurry is poured into molds corresponding to a shape of embodiments of the porous body as shown in FIG. 1 to form the shaped rough blank of the porous body.

In the step of S40, the rough blank is firstly kept warmth under a temperature of 300° C. for 6 hours, and then is sintered under a temperature of 1,000° C. for 3 hours to acquire the sintered porous body.

Embodiment 4

In a step of S10, raw material consisting of the following ingredients based on respective mass percentages is acquired. The ingredients include 55 g of diatomite, 10 g of aluminum oxide, 15 g of a sucrose pore former, 10 g of clay and 10 g of high-temperature glass powders.

The rest steps are proceeded same as the steps adopted in Embodiment 3 to acquire the finally sintered porous body.

In order to verify properties of the porous body manufactured by the method(s) of the above embodiment(s), porosity and pore diameters of the porous body are tested and diagnosed by a scanning electron microscope. Results are shown in the following table.

TABLE 1

| Embodiment(s) | Porosity | Average Pore Diameter |
|---|---|---|
| Embodiment 1 | 65% | 61 μm |
| Embodiment 2 | 78% | 67 μm |
| Embodiment 3 | 70% | 63 μm |
| Embodiment 4 | 72% | 64 μm |

Figure 22:
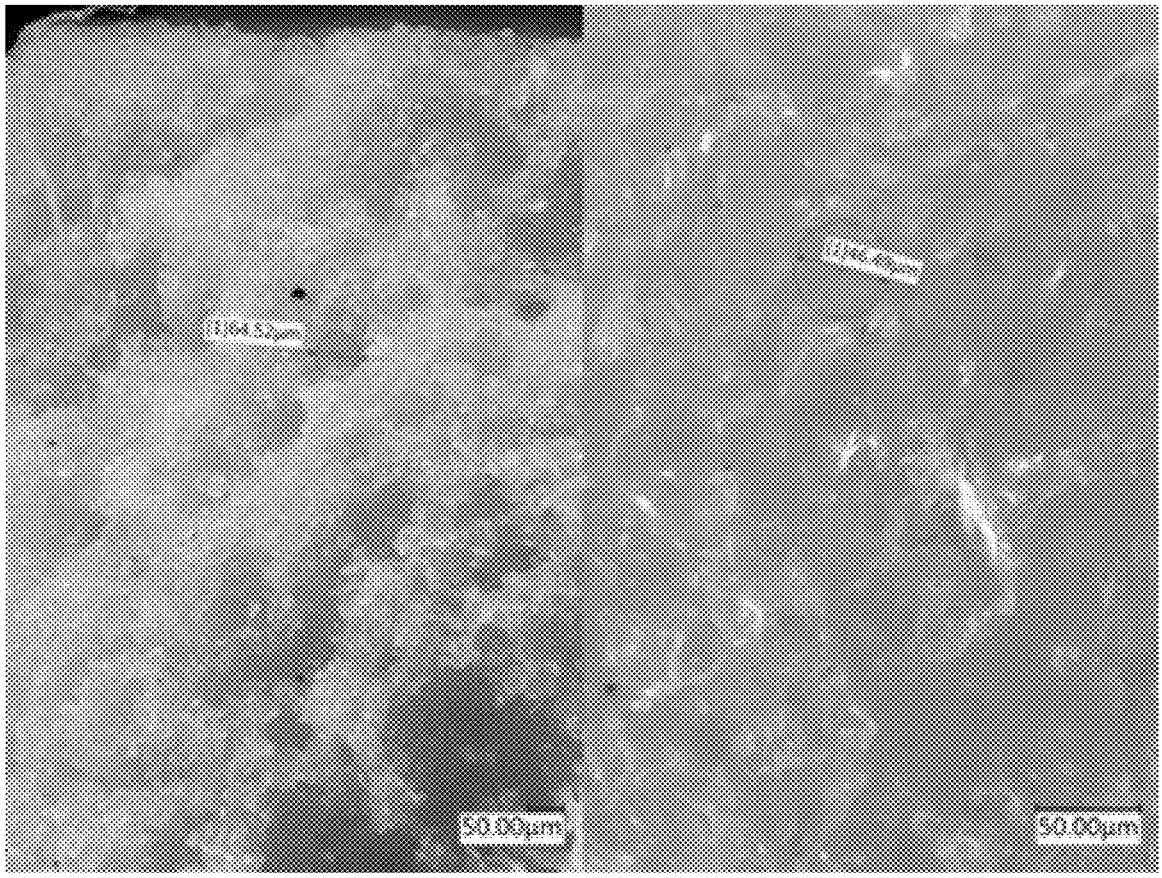
FIG. 22 shows a schematic cross-sectional electron microscope scanning analysis diagram showing scanning images of a porous body manufactured in accordance with a preferred embodiment of the present invention and a conventional ceramic rod.

Hence, the porous body manufactured in accordance with embodiments of the present invention basically has a porosity reaching 70% in view of the above testing result of pore diameters of micro-pores and porosity, and in comparison, an ordinary ceramic rod only has a porosity reaching 30%~60%. Besides, referring to FIG. 22, the porous body of Embodiment 4 and the ordinary ceramic rod are respectively cross-sectionally scanned and analyzed by an electron microscope, and an analyzed result thereof is enlarged for 200 times to be shown in FIG. 22. As shown in FIG. 22, a scanned result of the porous body of Embodiment 4 is shown in a left half of FIG. 22, and a scanned result of the ordinary ceramic rod in the market is shown in a right half of FIG. 22. According to the above results, a pore diameter of the porous body of Embodiment 4 is 64.52 μm, and a pore diameter of the ordinary ceramic rod is 46.49 μm based on its electron microscope analysis result. In comparison with the ordinary ceramic rod, the porous body manufactured in accordance with the present invention has advantages of fast aerosol generation and a relatively large quantity of aerosol when an electronic cigarette is equipped with the porous body.

It is required to explain that the above specification and its attached drawings are used to illustrate preferred embodiments of the present invention, but not used to be limited to the depicted embodiments in the specification. Furthermore, to the ordinary skilled in the art, they can make modification and alteration according to the above illustrations, and all of these modifications and alteration are still in the protective scope of claims attached below in accordance with the present invention.

What is claimed is:

1. A porous heating body, comprising a porous body for conducting liquid tobacco, wherein the porous body comprises a first porous portion, a second porous portion and a third porous portion respectively for conducting the liquid tobacco, and successively disposed in the porous body along a lengthwise direction of the porous body, a first through hole being formed in the porous body and extending along the lengthwise direction of the porous body to penetrate through the first porous portion, the second porous portion and the third porous portion successively, one of an inner surface of the second porous portion facing the first through hole and an outer surface of the second porous portion being disposed as a liquid tobacco absorbing face for contacting liquid tobacco while the other one of the inner surface of the second porous portion and the outer surface of the second porous portion being disposed as an atomizing face for atomizing the liquid tobacco from the liquid tobacco absorbing face, a cross-sectional area of the first porous portion and a cross-sectional area of the third porous portion are both larger than a cross-sectional area of the second porous portion along a widthwise direction of the porous body;

a heating element extending along the lengthwise direction of the porous body is disposed on the atomizing face, the heating element comprises a heating portion for atomizing the liquid tobacco acquired from the liquid tobacco absorbing face to the atomizing face via the second porous portion to generate aerosol, at least one portion of an extension length of the heating portion along the lengthwise direction of the porous body is overlapped with an extension length of the second porous portion.

2. The porous heating body as claimed in claim 1, wherein the cross-sectional area of the first porous portion along the widthwise direction of the porous body is constant; and/or the cross-sectional area of the second porous portion along the widthwise direction of the porous body is constant; and/or the cross-sectional area of the third porous portion along the widthwise direction of the porous body is constant.

3. The porous heating body as claimed in claim 1, wherein the cross-sectional area of the first porous portion along the widthwise direction of the porous body is gradually decreased along a forwarding direction of the lengthwise direction of the porous body toward the second porous portion.

4. The porous heating body as claimed in claim 1, wherein the first porous portion comprises a first conductive section and a second conductive section being successively disposed along a forwarding direction of the lengthwise direction of the porous body toward the second porous portion;

a cross-sectional area of the first conductive section along the widthwise direction of the porous body is constant; and a cross-sectional area of the second conductive section along the widthwise direction of the porous body is gradually decreased along the forwarding direction of the lengthwise direction of the porous body toward the second porous portion.

5. The porous heating body as claimed in claim 4, wherein the third porous portion comprises a third conductive section and a fourth conductive section being successively disposed along a forwarding direction of the lengthwise direction of the porous body toward the second porous portion;

a cross-sectional area of the third conductive section along the widthwise direction of the porous body is constant; and a cross-sectional area of the fourth conductive section along the widthwise direction of the porous body is gradually decreased along the forwarding direction of the lengthwise direction of the porous body toward the second porous portion.

6. The porous heating body as claimed in claim 1, wherein the cross-sectional area of the third porous portion along the widthwise direction of the porous body is gradually decreased along a forwarding direction of the lengthwise direction of the porous body toward the second porous portion.

7. An atomizer, comprising a hollowing outer shell, a liquid tobacco storage cavity disposed inside the outer shell for storing liquid tobacco, and the porous heating body as claimed in claim 1 being further disposed inside the outer shell to absorb liquid tobacco from the liquid tobacco storage cavity and to atomize the absorbed liquid tobacco.

8. The atomizer as claimed in claim 7, wherein an inner wall of the first through hole comprises a first liquid tobacco working face, the second porous portion comprises a second liquid tobacco working face corresponding to the first liquid tobacco working face along a radial direction of the first through hole; and when the porous body is set to comprise more than two through holes and the first through hole is set to be a preset through hole out of the more than two through holes, a distant between the first liquid tobacco working face and the second liquid tobacco working face is constant along a radial direction of the preset through hole.

9. The atomizer as claimed in claim 8, wherein the first through hole is used for conducting aerosol out, the first liquid tobacco working face is set to be the atomizing face for atomizing liquid tobacco, the heating portion of the heating element is disposed on the atomizing face, the second liquid tobacco working face is set to be the liquid tobacco contacting face to contact liquid tobacco in the liquid tobacco storage cavity.

10. The atomizer as claimed in claim 9, wherein the inner wall of the first through hole comprises two opposite atomizing faces, a first heating portion and a second heating portion are respectively disposed correspondingly on the two atomizing faces, the first heating portion and the second heating portion are electrically connected in parallel or in series.

11. The atomizer as claimed in claim 9, wherein a shortest conductive distance of liquid tobacco conducted through the liquid tobacco contacting face to a corresponding atomizing face is smaller than a distance between the inner wall of the first through hole and an outer surface of the first porous portion or the third porous portion along the radial direction of the first through hole.

12. The atomizer as claimed in claim 9, wherein the more than two through holes comprise the first through hole and a second through hole successively penetrating the first porous portion, the second porous portion and the third porous portion along the lengthwise direction of the porous body;

the heating element comprises a first heating portion disposed on the atomizing face of the first through hole, and a second heating portion disposed on an atomizing face of the second through hole, the first heating portion and the second heating portion are set to have different heating temperatures from each other.

13. The atomizer as claimed in claim 8, wherein the first through hole is communicated with the liquid tobacco storage cavity, the first liquid tobacco working face is set to be the liquid tobacco contacting face to contact liquid tobacco in the liquid tobacco storage cavity, and the second liquid tobacco working face is set to be the atomizing face for atomizing liquid tobacco, the heating portion is disposed on the atomizing face.

14. The atomizer as claimed in claim 7, wherein an aerosol conductive tube is disposed inside the outer shell to conduct aerosol atomized by the porous heating body from liquid tobacco out of the atomizer, a fixing seat is disposed inside the outer shell to fix the porous heating body, and a connecting piece is disposed inside the outer shell to connect the porous heating body with the aerosol conductive tube;

the fixing seat comprises a first accommodating portion to mate with the first porous portion;

the connecting piece comprises a second accommodating portion to mate with the third porous portion and a connecting portion to connect with the aerosol conductive tube;

the porous heating body is connected with the fixing seat through the first porous portion mating with the first accommodating portion, and is connected with the connecting piece through the third porous portion mating with the second accommodating portion.

15. The atomizer as claimed in claim 7, wherein the inner surface of the second porous portion facing the first through hole is disposed as the liquid tobacco absorbing face for contacting liquid tobacco while the outer surface of the second porous portion is disposed as the atomizing face for atomizing the liquid tobacco from the liquid tobacco absorbing face.

16. The atomizer as claimed in claim 7, wherein the inner surface of the second porous portion facing the first through hole is disposed as the atomizing face for atomizing the liquid tobacco from the liquid tobacco absorbing face while the outer surface of the second porous portion is disposed as the liquid tobacco absorbing face for contacting liquid tobacco.

17. The porous heating body as claimed in claim 1, wherein the inner surface of the second porous portion facing the first through hole is disposed as the liquid tobacco absorbing face for contacting liquid tobacco while the outer surface of the second porous portion is disposed as the atomizing face for atomizing the liquid tobacco from the liquid tobacco absorbing face.

18. The porous heating body as claimed in claim 1, wherein the inner surface of the second porous portion facing the first through hole is disposed as the atomizing face for atomizing the liquid tobacco from the liquid tobacco absorbing face while the outer surface of the second porous portion is disposed as the liquid tobacco absorbing face for contacting liquid tobacco.

* * * * *